US008663892B2

(12) United States Patent
Yaguchi et al.

(10) Patent No.: US 8,663,892 B2
(45) Date of Patent: Mar. 4, 2014

(54) LATENT ELECTROSTATIC IMAGE DEVELOPING CARRIER, PROCESS CARTRIDGE AND IMAGE FORMING APPARATUS

(75) Inventors: Shigenori Yaguchi, Shizuoka (JP); Kimitoshi Yamaguchi, Shizuoka (JP); Toyoshi Sawada, Kanagawa (JP); Hitoshi Iwatsuki, Shizuoka (JP); Toyoaki Tano, Shizuoka (JP); Hiroshi Tohmatsu, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 5 days.

(21) Appl. No.: 13/592,626

(22) Filed: Aug. 23, 2012

(65) Prior Publication Data

US 2013/0065171 A1 Mar. 14, 2013

(30) Foreign Application Priority Data

Sep. 8, 2011 (JP) ..... 2011-196277

(51) Int. Cl.
*G03G 9/113* (2006.01)

(52) U.S. Cl.
USPC ..... 430/111.32; 430/111.35; 430/111.4

(58) Field of Classification Search
USPC ..... 430/111.32, 111.35, 111.4
See application file for complete search history.

(56) References Cited

U.S. PATENT DOCUMENTS

| | | | | |
|---|---|---|---|---|
| 5,341,197 | A | 8/1994 | Folkins et al. | |
| 5,876,893 | A * | 3/1999 | Ochiai et al. | 430/111.33 |
| 2007/0019995 | A1 | 1/2007 | Teraoka et al. | |
| 2008/0063969 | A1 | 3/2008 | Yamaguchi et al. | |
| 2009/0123856 | A1 * | 5/2009 | Hotta et al. | 430/106.1 |
| 2010/0233613 | A1 | 9/2010 | Masuda et al. | |
| 2010/0239975 | A1 | 9/2010 | Yamaguchi et al. | |
| 2011/0065037 | A1 | 3/2011 | Iwatsuki et al. | |
| 2011/0086307 | A1 | 4/2011 | Nakajima et al. | |
| 2011/0171573 | A1 | 7/2011 | Sakata et al. | |
| 2011/0217649 | A1 | 9/2011 | Masuda et al. | |
| 2011/0229817 | A1 | 9/2011 | Yamada et al. | |
| 2012/0057898 | A1 | 3/2012 | Sakata et al. | |
| 2012/0058423 | A1 | 3/2012 | Yamaguchi et al. | |
| 2012/0064451 | A1 | 3/2012 | Kishida et al. | |

FOREIGN PATENT DOCUMENTS

| | | |
|---|---|---|
| JP | 07-072733 | 3/1995 |
| JP | 07-092813 | 4/1995 |
| JP | 07-128983 | 5/1995 |
| JP | 08-292607 | 11/1996 |
| JP | 11-065247 | 3/1999 |
| JP | 11-231652 | 8/1999 |
| JP | 3356948 | 10/2002 |
| JP | 2004-133178 | 4/2004 |
| JP | 2005-157002 | 6/2005 |
| JP | 2007-025693 | 2/2007 |
| JP | 2008-096975 | 4/2008 |
| JP | 4337523 | 7/2009 |
| JP | 2009-282209 | 12/2009 |
| JP | 4434060 | 1/2010 |
| JP | 2010-243798 | 10/2010 |

OTHER PUBLICATIONS

U.S. Appl. No. 13/412,195, filed Mar. 5, 2012, Sakata, et al.
U.S. Appl. No. 13/556,549, filed Jul. 24, 2012, Sakata, et al.

* cited by examiner

*Primary Examiner* — Hoa V Le
(74) *Attorney, Agent, or Firm* — Oblon, Spivak, McClelland, Maier & Neustadt, L.L.P.

(57) ABSTRACT

A latent electrostatic image developing carrier including: core particles each having magnetism; and a coating layer covering each of the core particles, wherein the latent electrostatic image developing carrier has a shape factor SF-2 of 115 to 150 and has a bulk density of 1.8 g/cm$^3$ to 2.4 g/cm$^3$, wherein the core particles have a shape factor SF-2 of 120 to 160 and have an arithmetic mean surface roughness Ra of 0.5 μm to 1.0 μm, and wherein the coating layer contains a resin and a filler and an amount of the filler contained in the coating layer is 50 parts by mass to 500 parts by mass per 100 parts by mass of the resin contained in the coating layer.

13 Claims, 3 Drawing Sheets

LATENT ELECTROSTATIC IMAGE DEVELOPING CARRIER, PROCESS CARTRIDGE AND IMAGE FORMING APPARATUS

BACKGROUND OF THE INVENTION

1. Field of the Invention

The present invention relates to a latent electrostatic image developing carrier, a process cartridge and an image forming apparatus.

2. Description of the Related Art

In recent years, technologies of copiers and printers based on electrophotography have rapidly been changed from monochromatic modes to full-color modes, and the market of full-color modes tends to expand. In color image formation by full-color electrophotography, a latent electrostatic image is formed on a latent electrostatic image bearing member. Next, the latent electrostatic image is developed with charged three color toners of yellow, magenta and cyan or with charged four color toners of yellow, magenta, cyan and black to thereby form toner images, which are then transferred onto a recording medium, followed by fixing.

In order to form a clear full-color image through such image formation by full-color electrophotography, it is necessary to keep the amount of the toner on the latent electrostatic image bearing member depending on the latent electrostatic image. The fluctuation of the amount of the toner on the latent electrostatic image bearing member results in fluctuation in image density and color tone on a recording medium. The fluctuation of the amount of the toner on the latent electrostatic image bearing member is due to, for example, fluctuation in charge amount of toner. In particular, in the hybrid developing method, there have been reported that the difference in amount of a toner from place to place on a toner bearing member causes a difference in image density on the next development, which is so-called hysteresis (ghost phenomenon) (see, for example, Japanese Patent Application Laid-Open (JP-A) No. 2007-25693).

In one effective method for overcoming hysteresis in the hybrid developing method, the toner remaining on the toner bearing member after development of the latent electrostatic image on the latent electrostatic image bearing member is removed and then an unused toner is supplied to the surface of the toner bearing member, to thereby compensate the above-described difference in amount of the toner on the toner bearing member. For example, there has been proposed a method of overcoming hysteresis by scraping off the remaining toner from the toner bearing member with a scraper or a toner recovering roller after development and before supply of an unused toner (see, for example, Japanese Patent (JP-B) No. 3356948 and JP-A Nos. 2005-157002 and 11-231652). Also, there has been proposed a method of overcoming hysteresis by recovering the remaining toner from the toner bearing member with a magnetic roller utilizing the difference in electrical potential, to thereby stabilize the amount of the toner on the toner bearing member (see, for example, JP-A No. 07-072733). Furthermore, there has been proposed a method of overcoming hysteresis by providing a wide half-width region between a developer bearing member and a toner bearing member in which region the half value of the peak of the magnetic flux density of a magnetic roller is observed, to thereby stabilize recovery and supply of the toner with respect to the developer bearing member (see, for example, JP-A No. 07-128983). Moreover, there has been proposed a method of overcoming hysteresis by keeping constant the amount of the toner on the toner bearing member where non-spherical carrier particles are used as a carrier of a two-component developer. Specifically, charges are injected into the carrier particles at the tips of the magnetic brushes; the distance between the developer bearing member and the toner bearing member is made small; the amount of the toner to be supplied at one time to the toner bearing member is increased; and the toner is supplied onto the toner bearing member in such an amount that the amount of the toner thereon is saturated (see, for example, JP-A No. 07-092813).

The above-described hysteresis is said to be a specific problem to the hybrid developing method. However, when a developer is used for a long period of time in the two-component developing method, there has been reported that the developing capability of the developer degrades to cause hysteresis where the image density decreases (see, for example, JP-A No. 11-065247).

Hysteresis occurring in the two-component developing method results from inappropriate removal of a two-component developer. The removal of the developer is performed at a removal region having a magnetic force of almost 0, which is formed by an odd number of magnets provided in the developing sleeve and magnets of the same polarity provided below the rotation shaft of the developing sleeve. In the removal region, the developer after development is allowed to freely fall due to gravitational force. However, counter charges are generated on the carrier when the toner is consumed for forming the previous image to thereby form mirror image force between the carrier and the developer bearing member, resulting that the developer cannot normally be removed. Thus, the developer in which the concentration of the toner has been lowered as a result of consumption of the toner is transferred again to the developing region to reduce the developing capability. In other words, the density of the image formed at the first rotation of the sleeve is normal, while the density of the images formed at the second and subsequent rotations is low.

Furthermore, one proposed method of overcoming hysteresis in the two-component developing method is a method of removing the developer after development using magnetic force generated from pumping rollers each having a magnet therein which are arranged near the removal region on the developing sleeve (see, for example, JP-A No. 11-065247). The developer that has been removed is pumped up with another pumping roller and then transferred to a developer-stirring chamber having a screw, where the concentration of the toner is adjusted again and the toner is charged.

However, even with the above-described proposal, the developer is affected by hysteresis after continuously used for a long period of time. Thus, problematically, it is not possible to stably supply a necessary amount of toner to a latent electrostatic image bearing member. In addition, the above proposal cannot reduce an increase in resistance of a carrier caused by toner spent which is a specific problem in the two-component developing method. Therefore, keen demand has arisen for a measure to solve such problems at the same time.

SUMMARY OF THE INVENTION

The present invention has been made under such circumstances, and aims to solve the above existing problems and achieve the following objects. Specifically, the present invention aims to provide a latent electrostatic image developing carrier and a process cartridge and an image forming apparatus each using the latent electrostatic image developing carrier, where the latent electrostatic image developing carrier, even when used continuously for a long period of time, can stably supply a necessary amount of toner to a latent electrostatic image bearing member without being affected by hysteresis, and can prevent an increase in resistance due to deposition of spent toner thereon.

Hysteresis to be solved by the present invention differs from the above hysteresis in a mechanism where it occurs.

Although it has not been clearly elucidated in detail, the mechanism where ghost phenomenon in the present invention occurs is thought to be as follows. Specifically, toner particles are attached onto the developer bearing member depending on the hysteresis of the previous image, and as a result the amount of the toner used for developing the next image varies with the potential of the toner particles attached on the developer bearing member. In other words, the ghost phenomenon is thought to be caused by change in amount of toner used for developing the next image due to the hysteresis of the previous image.

In more detail, a potential with which toner particles are moved from the latent electrostatic image bearing member to the developing sleeve is formed in the non-image portion opposite to a potential in the image portion, and as a result, the toner is directly deposited onto the developer bearing member (toner deposition occurs on the developer bearing member). When the image portion is developed on the next development in this state where the toner is deposited on the developer bearing member, the developing potential is increased by the potential of the toner on the developer bearing member to increase the amount of toner used for the development, since the toner directly deposited on the developer bearing member is charged.

Also, the toner directly deposited on the developer bearing member is consumed during development. Thus, the amount thereof is not constant and varies with the hysteresis of the previous image.

That is, when there are non-image portions and spaces between paper sheets immediately before image formation, the above-described developing potential is increased in developing the subsequent image portion, increasing the image density of the subsequent images. When the previous image is an image having an image occupation rate, the toner directly deposited onto the developer bearing member is consumed for developing the previous image, and the above-described developing potential is increased to less extent, not increasing the image density of the subsequent images.

As described above, the hysteresis to be solved by the present invention is a phenomenon where the density of the next image changes due to change in amount of toner deposited on the developer bearing member depending on the previous image.

The present inventors conducted extensive studies to solve the above problems and found that a latent electrostatic image developing carrier having the constitution of the present invention, even when used continuously for a long period of time, can stably supply a necessary amount of toner to a latent electrostatic image bearing member without being affected by hysteresis, and can prevent an increase in resistance due to deposition of spent toner thereon. The present invention has been accomplished on the basis of the finding.

The present invention is based on the finding obtained by the present inventors. Means for solving the above existing problems are as follows. Specifically, a latent electrostatic image developing carrier of the present invention includes: core particles each having magnetism; and a coating layer covering each of the core particles, wherein the latent electrostatic image developing carrier has a shape factor SF-2 of 115 to 150 and has a bulk density of 1.8 g/cm$^3$ to 2.4 g/cm$^3$, wherein the core particles have a shape factor SF-2 of 120 to 160 and have an arithmetic mean surface roughness Ra of 0.5 μm to 1.0 μm, and wherein the coating layer contains a resin and a filler and an amount of the filler contained in the coating layer is 50 parts by mass to 500 parts by mass per 100 parts by mass of the resin contained in the coating layer.

The present invention can provide a latent electrostatic image developing carrier and a process cartridge and an image forming apparatus each using the latent electrostatic image developing carrier, where the latent electrostatic image developing carrier, even when used continuously for a long period of time, can stably supply a necessary amount of toner to a latent electrostatic image bearing member without being affected by hysteresis, and can prevent an increase in resistance due to deposition of spent toner thereon.

Figure 1:
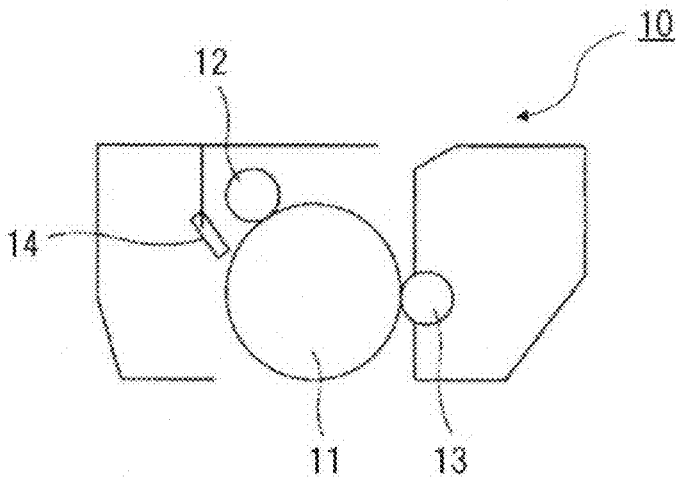
FIG. 1 illustrates one exemplary process cartridge of the present invention.

DETAILED DESCRIPTION OF THE INVENTION (Latent Electrostatic Image Developing Carrier)

A latent electrostatic image developing carrier of the present invention includes core particles and a coating layer covering each of the core particles; and, if necessary, further includes other ingredients.

<Core Particles>

The core particles are not particularly limited and may be appropriately selected depending on the intended purpose, so long as they are core particles each having magnetism. Examples thereof include ferromagnetic metals such as iron and cobalt; iron oxides such as magnetite, hematite and ferrite; and resin particles formed by dispersing in a resin a magnetic material such as alloys and compounds. Among them, Mn ferrites, Mn—Mg ferrites and Mn—Mg—Sr ferrites are preferred since they are environmentally friendly.

—Shape Factor SF-1 of Core Particles—

The core particles are defined by shape factor SF-1.

The SF-1 defines the degree of circularity of the particles.

As the SF-1 becomes greater, the shape of the particles deviates from a circle (spherical shape).

The shape factor SF-1 of the core particles is not particularly limited and may be appropriately selected depending on the intended purpose.

The shape factor SF-1 of the core particles was measured as follows. Specifically, the core particles were observed at a magnification of ×300 under a scanning electron microscope (e.g., FE-SEM (S-800), product of Hitachi, Ltd.). Then, 100 core particles on the obtained image were randomly sampled and the obtained image information was analyzed with an image analyzer (e.g., Luzex AP, product of NIRECO CORPORATION), followed by calculation using the following equation (1):

$$SF\text{-}1=(L^2/A)\times(\pi/4)\times 100 \quad (1)$$

in the above equation (1), L denotes an absolute maximum length (a length of the circumcircle) of each core particle and A denotes a projected area of each core particle.

—Shape Factor SF-2 of Core Particles—

The core particles are defined by shape factor SF-2.

The SF-2 defines the degree of irregularity of the particles.

As the SF-2 becomes greater, the irregularity on the surfaces of the particles becomes larger.

The shape factor SF-2 of the core particles is not particularly limited and may be appropriately selected depending on the intended purpose, so long as it is 120 to 160. When the shape factor SF-2 is less than 120, it becomes easy for convex portions of the core particles to be covered, potentially making it difficult to form local low-resistance regions. When the shape factor SF-2 is more than 160, the amount of voids of the core particles increases to decrease the strength of the core particles. In addition, when the formed carrier is used in a developing device for a long time, the core particles are exposed to a large extent, which leads to a great change in resistance between before and after use. As a result, the amount of the toner on the latent electrostatic image bearing member and the way of forming a toner image are changed to potentially change the image density.

The shape factor SF-2 of the core particles was measured as follows. Specifically, the core particles were observed at a magnification of ×300 under a scanning electron microscope (e.g., FE-SEM (S-800), product of Hitachi, Ltd.). Then, 100 core particles on the obtained image were randomly sampled and the obtained image information was analyzed with an image analyzer (e.g., Luzex AP, product of NIRECO CORPORATION), followed by calculation using the following equation (2):

$$\text{SF-2}=(P^2/A)\times(1/4\pi)\times 100 \quad (2)$$

in the above equation (2), P denotes a perimeter of each core particle and A denotes a projected area of each core particle.

—Arithmetic Mean Surface Roughness Ra of Core Particles—

The arithmetic mean surface roughness Ra of the core particles defines the surface roughness of the core particles.

Defining the arithmetic mean surface roughness Ra of the core particles has the meaning that deformed core particles having a shape factor SF-2 of 120 to 160 but greatly deviating the spherical shape cause considerable carrier deposition and thus cannot be used in the present invention.

The arithmetic mean surface roughness Ra of the core particles is not particularly limited, so long as it is 0.5 μm to 1.0 μm, and may be appropriately selected depending on the intended purpose, but is preferably 0.6 μm to 0.9 μm.

The arithmetic mean surface roughness Ra of the core particles was measured using an optical microscope (e.g., OPTELICS C130, product of LASERTEC CORPORATION) as follows. Specifically, an image was taken in at a resolution of 0.20 μm with the objective lens adjusted to a magnification of ×50. Then, the observation area was defined to be 10 μm×10 μm around the apex of each core particle, and the surface roughnesses Ras of 100 core particles were averaged.

—Grain Size of Core Particles—

The grain size of the core particles is not particularly limited and may be appropriately selected depending on the intended purpose, but is preferably 2 μm to 8 μm.

—BET Specific Surface Area of Core Particles—

The BET specific surface area of the core particles is not particularly limited and may be appropriately selected depending on the intended purpose, but is preferably 0.09 $m^2/g$ to 0.40 $m^2/g$.

—Weight Average Particle Diameter Dw of Core Particles—

The weight average particle diameter Dw of the core particles refers to a particle diameter at an integrated value of 50% in a particle size distribution of the core particles measured by the laser diffraction/scattering method. The weight average particle diameter Dw of the core particles is not particularly limited and may be appropriately selected depending on the intended purpose, but is preferably 10 μm to 80 μm.

The weight average particle diameter Dw of the core particles was measured as follows. Specifically, the particle size distribution on the number basis (the relationship between number frequency and particle diameter) was measured using a MICROTRACK particle distribution analyzer (HRA9320-X100, product of Honewell Co.) under the following conditions and the Dw was calculated using the following equation (3). Notably, the number of channels was that dividing into unit ranges the particle diameter range in the particle size distribution chart, and the representative particle diameter adopted was the lowest value of the particle diameters stored in each channel.

$$Dw=\{1/\Sigma(nD^3)\}\times\{\Sigma(nD^4)\} \quad (3)$$

in the above equation (3), D denotes a representative particle diameter (μm) of core particles present in each channel, and n denotes the total number of core particles present in each channel.

[Measurement Conditions]

[1] Particle diameter range: 100 μm to 8 μm

[2] Channel length (channel width): 2 μm

[3] Channel number: 46

[4] Refractive index: 2.42

<Coating Layer>

The coating layer is formed from a coating layer forming solution containing a resin and a filler.

The coating layer is not particularly limited and may be appropriately selected depending on the intended purpose, so long as it is contains 50 parts by mass to 500 parts by mass of the filler per 100 parts by mass of the resin. Preferably, the coating layer contains 100 parts by mass to 300 parts by mass of the filler per 100 parts by mass of the resin. When the amount of the filler is less than 50 parts by mass, the coating layer may be abraded. When it is more than 500 parts by mass, the amount of the resin exposed to the carrier surface becomes smaller, resulting in that the toner may be easier to cause spent on the carrier surface. When the amount of the filler falls within the above preferred range, it is advantageous in that the coating layer is hardly abraded even after the formed carrier has been used in a developing device for a long period of time.

When the thickness of the coating layer is too small, the surfaces of the core particles are easily exposed due to stirring in a developing device, potentially changing in resistance greatly. When it is too large, the convex portions of the core particles are not exposed to make it difficult to form local low-resistance regions. The thickness of the coating layer can be controlled by adjusting the amount of the resin contained in the core particles. The amount of the resin contained in the core particles is not particularly limited and may be appropriately selected depending on the intended purpose. It is preferably 0.5% by mass to 3.0% by mass since the thickness of the formed coating layer can form local low-resistance regions.

—Resin—

The resin is not particularly limited and may be appropriately selected depending on the intended purpose. Examples thereof include acrylic resins, amino resins, polyvinyl resins, polystyrene resins, halogenated olefin resins, polyesters, polycarbonates, polyethylenes, polyvinyl fluorides, polyvinylidene fluorides, polytrifluoroethylenes, polyhexafluoropropylenes, copolymers of vinylidene fluorides and vinyl fluorides, fluoroterpolymers such as terpolymers of tetrafluoroethylene, vinylidene fluoride, non-fluoride monomer, and silicone resins. These may be used alone or in combination. Among them, silicone resins are preferred.

The resin is not particularly limited and may be appropriately selected depending on the intended purpose, but is preferably a resin containing a cured product of a mixture of a silane coupling agent and a silicone resin.

—Silicone Resin—

The silicone resin is not particularly limited and may be appropriately selected depending on the intended purpose. It is preferably a resin containing a crosslinked product formed by hydrolyzing a copolymer containing at least unit A represented by the following General Formula (A) and unit B represented by the following General Formula (B) to form a silanol group, followed by condensation:

General Formula (A)

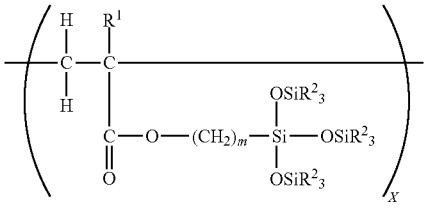

in General Formula (A), $R^1$ represents a hydrogen atom or a methyl group, $R^2$ represents an alkyl group having 1 to 4 carbon atoms, m is an integer of 1 to 8, and X is a molar ratio of the unit A in the copolymer and is 10 mol % to 90 mol %, General Formula (B)

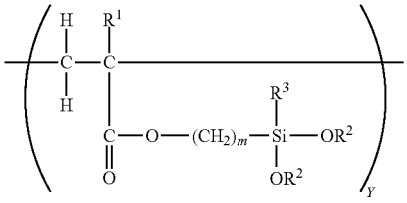

in General Formula (B), $R^1$ represents a hydrogen atom or a methyl group, $R^2$ represents an alkyl group having 1 to 4 carbon atoms, $R^3$ represents an alkyl group having 1 to 8 carbon atoms or an alkoxy group having 1 to 4 carbon atoms, m is an integer of 1 to 8, and Y is a molar ratio of the unit B in the copolymer and is 10 mol % to 90 mol %.

—Silane Coupling Agent—

A silane coupling agent can stably disperse the filler.

The silane coupling agent is not particularly limited and may be appropriately selected depending on the intended purpose. Examples thereof include γ-(2-aminoethyl)aminopropyltrimethoxysilane, γ-(2-aminoethyl)aminopropylmethyldimethoxysilane, γ-methacryloxypropyltrimethoxysilane, N-β-(N-vinylbenzylaminoethyl)-γ-aminopropyltrimethoxysilane hydrochloride, γ-glycidoxypropyltrimethoxysilane, γ-mercaptopropyltrimethoxysilane, methyltrimethoxysilane, methyltriethoxysilane, vinyltriacetoxysilane, γ-chloropropyltrimethoxysilane, hexamethyldisilazane, γ-anilinopropyltrimethoxysilane, vinyltrimethoxysilane, octadecyldimethyl[3-(trimethoxysilyl)propyl]ammonium chloride, γ-chloropropylmethyldimethoxysilane, methyltrichlorosilane, dimethyldichlorosilane, trimethylchlorosilane, allyltriethoxysilane, 3-aminopropylmethyldiethoxysilane, 3-aminopropyltrimethoxysilane, dimethyldiethoxysilane, 1,3-divinyltetramethyldisilazane and methacryloxyethyldimethyl(3-trimethoxysilylpropyl)ammonium chloride. These may be used alone or in combination.

Examples of commercially available products of the silane coupling agent include AY43-059, SR6020, SZ6023, SH6020, SH6026, SZ6032, SZ6050, AY43-310M, SZ6030, SH6040, AY43-026, AY43-031, sh6062, Z-6911, sz6300, sz6075, sz6079, sz6083, sz6070, sz6072, Z-6721, AY43-004, Z-6187, AY43-021, AY43-043, AY43-040, AY43-047, Z-6265, AY43-204M, AY43-048, Z-6403, AY43-206M, AY43-206E, Z6341, AY43-210MC, AY43-083, AY43-101, AY43-013, AY43-158E, Z-6920 and Z-6940 (these products are of Dow Corning Toray Co., Ltd.).

The amount of the silane coupling agent is not particularly limited and may be appropriately selected depending on the intended purpose, but is preferably 0.1% by mass to 10% by mass relative to the amount of the resin. When the amount thereof is less than 0.1% by mass, the adhesiveness between the core particles, the filler and the resin is degraded, and the coating layer may be delaminated during long-term use. When it is more than 10% by mass, toner filming may occur during long-term use.

—Filler—

The filler is not particularly limited and may be appropriately selected depending on the intended purpose. Examples thereof include electroconductive fillers and non-electroconductive fillers. These may be used alone or in combination. Among them, both of an electroconductive filler and a non-electroconductive filler are preferably incorporated into the coating layer.

The electroconductive filler refers to a filler having a powder specific resistance of 100 Ω·cm or less.

The non-electroconductive filler refers to a filler having a powder specific resistance of more than 100 Ω·cm.

The powder specific resistance of the filler was measured using a powder resistance measuring system (MCP-PD51, product of DIAINSTRUMENTS CO., LTD.) and a resistance meter (the 4-terminal 4-probe method, LORESTA-GP, product of Mitsubishi Chemical Analytech Co., Ltd.) under the following conditions: sample amount: 1.0 g, interelectrode distance: 3 mm, sample radius: 10.0 mm and load: 20 kN.

—Electroconductive Filler—

The electroconductive filler is not particularly limited and may be appropriately selected depending on the intended purpose. Examples thereof include electroconductive fillers each containing a base of, for example, aluminum oxide, titanium oxide, zinc oxide, barium sulfate, silicon oxide or zirconium oxide; and a layer of tin dioxide or indium oxide where the layer is formed on the base. Further examples include an electroconductive filler made of carbon black. Among them, electroconductive fillers containing aluminum oxide, titanium oxide or barium sulfate are preferred.

—Non-Electroconductive Filler—

The non-electroconductive filler is not particularly limited and may be appropriately selected depending on the intended purpose. Examples thereof include non-electroconductive fillers made of aluminum oxide, titanium oxide, barium sulfate, zinc oxide, silicon dioxide or zirconium oxide. Among them, non-electroconductive fillers containing aluminum oxide, titanium oxide or barium sulfate are preferred.

—Number Average Particle Diameter of Filler—

The number average particle diameter of the filler is not particularly limited and may be appropriately selected depending on the intended purpose. It is preferably 50 nm to 800 nm, more preferably 200 nm to 700 nm, since the filler is easier to be exposed to the surface of the resin contained in the coating layer to thereby easily form partial low-resistance regions where spent matter on the carrier surface is easily scraped off and the formed carrier is excellent in abrasion resistance. The number average particle diameter of the filler was measured as follows. The filler was observed at a magnification of ×10,000 under a scanning electron microscope (e.g., FE-SEM (S-800), product of Hitachi, Ltd.). Then, 100 fillers on the obtained image were randomly sampled and measured for particle diameter, and the obtained particle diameters were averaged to obtain the number average particle diameter.

<Other Ingredients>

The other ingredients are not particularly limited and may be appropriately selected depending on the intended purpose. The coating layer preferably contains a catalyst and may optionally contain a solvent and a curing agent.

—Catalyst—

The catalyst is not particularly limited and may be appropriately selected depending on the intended purpose. Examples thereof include titanium catalysts, tin catalysts, zirconium catalysts and aluminum catalysts. Specific examples include their acetyacetonato complexes, their alkylacetoacetato complexes, and their salicylaldehydato complexes. These may be used alone or in combination. Among them, titanium catalysts are preferred and diisopropoxybis (ethylacetoacetate)titanium is more preferred, since they considerably accelerate the condensation reaction of the silanol group and is hardly deactivated.

<Method for Producing Latent Electrostatic Image Developing Carrier>

A method for producing the latent electrostatic image developing carrier is not particularly limited and may be appropriately selected depending on the intended purpose. In a preferred method, a fluidized-bed coating apparatus is used to coat the surfaces of the core particles with a coating layer forming solution containing the resin and the filler, to thereby produce the latent electrostatic image developing carrier. Notably, the condensation of the resin contained in the coating layer may be allowed to proceed upon coating of the coating layer forming solution. Alternatively, the condensation of the resin contained in the coating layer may be allowed to proceed after coating of the coating layer forming solution. The method for the condensation of the resin is not particularly limited and may be appropriately selected depending on the intended purpose. Examples thereof include a method where heat or light is applied to the coating layer forming solution to thereby condensate the resin.

—Shape Factor SF-2 of Latent Electrostatic Image Developing Carrier—

The latent electrostatic image developing carrier is defined by shape factor SF-2.

The SF-2 defines the degree of irregularity of the particles.

As the SF-2 becomes greater, the irregularity on the surfaces of the particles becomes larger.

The shape factor SF-2 of the latent electrostatic image developing carrier is not particularly limited, so long as it is 115 to 150, and may be appropriately selected depending on the intended purpose. The shape factor SF-2 thereof is preferably 120 to 145 since the core particles are coated while still retaining a certain degree of irregularities.

The shape factor SF-2 of the latent electrostatic image developing carrier was measured as follows. Specifically, the latent electrostatic image developing carrier was observed at a magnification of ×300 under a scanning electron microscope (e.g., FE-SEM (S-800), product of Hitachi, Ltd.). Then, 100 particles of the latent electrostatic image developing carrier on the obtained image were randomly sampled and the obtained image information was analyzed with an image analyzer (e.g., Luzex AP, product of NIRECO CORPORATION), followed by calculation using the following equation (4):

$$SF\text{-}2=(P^2/A)\times(1/4\pi)\times 100 \quad (4)$$

in the above equation (4), P denotes a perimeter of each carrier particle and A denotes a projected area of each carrier particle.

—Bulk Density of Latent Electrostatic Image Developing Carrier—

The bulk density of the latent electrostatic image developing carrier is particularly limited, so long as it is 1.8 g/cm$^3$ to 2.4 g/cm$^3$, and may be appropriately selected depending on the intended purpose. When the bulk density thereof is less than 1.8 g/cm$^3$, there easily occurs so-called carrier deposition where carrier particles are deposited on the latent electrostatic image bearing member. When it is more than 2.4 g/cm$^3$, the latent electrostatic image developing carrier has greater stress due to stirring in a developing device, resulting in that the latent electrostatic image developing carrier may be greatly changed in resistance.

The bulk density of the latent electrostatic image developing carrier was measured by dropping the latent electrostatic image developing carrier from a height of 25 mm to a 25 cm$^3$ container through a funnel having an orifice diameter of 3 mm.

—BET Specific Surface Area of Latent Electrostatic Image Developing Carrier—

The BET specific surface area of the latent electrostatic image developing carrier is not particularly limited and may be appropriately selected depending on the intended purpose, but is preferably 2.5 m$^2$/g to 6.0 m$^2$/g.

—Weight Average Particle Diameter Dw of Latent Electrostatic Image Developing Carrier—

The weight average particle diameter Dw of the latent electrostatic image developing carrier refers to a particle diameter at an integrated value of 50% in a particle size distribution of the latent electrostatic image developing carrier measured by the laser diffraction/scattering method. The weight average particle diameter Dw of the latent electrostatic image developing carrier is not particularly limited and may be appropriately selected depending on the intended purpose, but is preferably 10 μm to 80 μm.

The weight average particle diameter Dw of the latent electrostatic image developing carrier was measured as follows. Specifically, the particle size distribution on the number basis (the relationship between number frequency and particle diameter) was measured using a MICROTRACK particle distribution analyzer (HRA9320-X100, product of Honewell Co.) under the following conditions and the Dw was calculated using the following equation (5). Notably, the number of channels was that dividing into unit ranges the particle diameter range in the particle size distribution chart, and the representative particle diameter adopted was the lowest value of the particle diameters stored in each channel.

$$Dw=\{1/\Sigma(nD^3)\}\times\{\Sigma(nD^4)\} \quad (5)$$

in the above equation (5), D denotes a representative particle diameter (μm) of core particles present in each channel, and n denotes the total number of core particles present in each channel.

[Measurement Conditions]

[1] Particle diameter range: 100 μm to 8 μm

[2] Channel length (channel width): 2 μm

[3] Channel number: 46

[4] Refractive index: 2.42

<Effects>

The latent electrostatic image developing carrier of the present invention, even when used continuously for a long period of time, can stably supply a necessary amount of toner to a latent electrostatic image bearing member without being affected by hysteresis, and can prevent an increase in resistance due to deposition of spent toner thereon. Therefore, the latent electrostatic image developing carrier can suitably be used as the below-described developer.

(Developer)

A developer contains: the above-described latent electrostatic image developing carrier of the present invention; and a toner.

<Toner>

The toner contains a binder resin, a charge-controlling agent and a releasing agent; and, if necessary, further contains other ingredients.

—Binder Resin—

The binder resin is not particularly limited and may be appropriately selected depending on the intended purpose. Examples thereof include: homopolymers of styrene and substituted products thereof (e.g., polystyrenes and polyvinyltoluenes); styrene binder resins such as styrene copolymers (e.g., styrene-p-chlorostyrene copolymers, styrene-propylene copolymers, styrene-vinyltoluene copolymers, styrene-methyl acrylate copolymers, styrene-ethyl acrylate copolymers, styrene-butyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ether copolymers, styrene-vinyl methyl ketone copolymers, styrene-butadiene copolymers, styrene-isoprene copolymers, styrene-maleic acid copolymers and styrene-maleic acid ester copolymers); acrylic binder resins such as polymethyl methacrylates and polybutyl methacrylates; polyvinyl chloride resins; polyvinyl acetate resins; polyethylene resins; polypropylene resins, polyester resins; polyurethane resins; epoxy resins; polyvinyl butyral resins; polyacrylic acid resins; rosin; modified rosin; terpene resins; phenol resins; aliphatic or alicyclic hydrocarbon resins; aromatic petroleum resins; chlorinated paraffins; and paraffin waxes. These may be used alone or in combination. Among them, polyester resins are preferred since they can reduce the melt viscosity of the formed toner while securing stability thereof during storage.

—Polyester Resin—

The polyester resin is not particularly limited and may be appropriately selected depending on the intended purpose. Examples thereof include resins obtained through polycondensation reaction between an alcohol component and a carboxylic acid component. The polyester resin may be used in combination with a crystalline polyester resin.

—Alcohol Component—

The alcohol component is not particularly limited and may be appropriately selected depending on the intended purpose. Examples thereof include: diols such as polyethylene glycol, diethylene glycol, triethylene glycol, 1,2-propylene glycol, 1,3-propylene glycol, 1,4-propylene glycol, neopentyl glycol and 1,4-butenediol; 1,4-bis(hydroxymethyl)cyclohexane, bisphenol A, hydrogenated bisphenol A and etherated bisphenols (e.g., polyoxyethylenated bisphenol A and polyoxypropylenated bisphenol A), dihydric alcohol monomers which are the above-listed components each further having as a substituent a saturated or unsaturated hydrocarbon group having 3 to 22 carbon atoms, and other dihydric alcohol monomers; and tri- or higher hydric alcohol monomers such as sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxymethylbenzene.

—Carboxylic Acid Component—

The carboxylic acid component is not particularly limited and may be appropriately selected depending on the intended purpose. Examples thereof include: monocarboxylic acids such as palmitic acid, stearic acid and oleic acid; dicarboxylic acids such as maleic acid, fumaric acid, mesaconic acid, citraconic acid, terephthalic acid, cyclohexanedicarboxylic acid, succinic acid, adipic acid, sebacic acid and malonic acid; divalent organic acid monomers which are the above-listed dicarboxylic acids each further having as a substituent a saturated or unsaturated hydrocarbon group having 3 to 22 carbon atoms; anhydrides of these acids; dimer acids formed between lower alkyl esters and linoleic acid; and tri- or higher valent polycarboxylic acid monomers such as 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl) methane, 1,2,7,8-octanetetracarboxylic acid, ENPOL trimer acid, and anhydrides of these acids.

—Crystalline Polyester Resin—

The crystalline polyester resin is a resin added for improving fixation of the toner at low temperatures and glossiness of the images at low temperatures. The crystalline polyester resin is also a resin which undergoes crystal transition at a glass transition temperature, drastically decreases in melt viscosity from the solid state, and exhibits fixing functions on a recording medium such as paper.

The crystalline polyester resin is expressed by a crystallinity index which is defined as a ratio of the softening point to the highest endothermic peak temperature measured by a differential scanning calorimeter (DSC); i.e., the softening point/the highest endothermic peak temperature. The crystallinity index of the crystalline polyester resin is not particularly limited and may be appropriately selected depending on the intended purpose, but is preferably 0.6 to 1.5, more preferably 0.8 to 1.2.

The amount of the crystalline polyester resin is preferably 1 part by mass to 35 parts by mass, more preferably 1 part by mass to 25 parts by mass, per 100 parts by mass of the polyester resin. When the amount of the crystalline polyester resin is more than 35 parts by mass, filming is easier to occur on the surface of an image bearing member, and the storage stability may be degraded.

—Charge-Controlling Agent—

The charge-controlling agent is used for sufficiently controlling frictional chargeability of the toner.

The charge-controlling agent is not particularly limited and may be appropriately selected depending on the intended purpose. Examples thereof include metal complex salts of monoazo dyes, nitrohumic acid and salts thereof, metal salts of salicylic acid and derivatives thereof, naphthoic acid salts, metal (e.g., Co, Cr or Fe) complex amino compounds of dicarboxylic acids, quaternary ammonium compounds and organic dyes. These may be used alone or in combination. Among them, when the toner is a color toner other than black toner, preferred is a white or transparent charge-controlling agent such as a white metal salt of a salicylic acid derivative.

—Releasing Agent—

The releasing agent is not particularly limited and may be appropriately selected depending on the intended purpose. Examples thereof include low-molecular-weight polypropylenes, low-molecular-weight polyethylenes, carnauba waxes, microcrystalline waxes, jojoba wax, rice wax and montanoic acid wax. These may be used alone or in combination.

—Other Ingredients—

The other ingredients are not particularly limited and may be appropriately selected depending on the intended purpose. Examples thereof include an additive, a magnetic material and a colorant.

—Additive—

The additive is added for imparting sufficient flowability to the toner and obtaining good images.

The additive is not particularly limited and may be appropriately selected depending on the intended purpose. Examples thereof include a polishing agent, a lubricating agent, a flowability-imparting agent and a caking-preventing agent. Specific examples include organic fine resin particles such as hydrophobized silicon carbide; fine metal particles such as zinc stearate, cerium oxide, hydrophobic silica and hydrophobic titanium dioxide; metal soap and fluorine resins. These may be used alone or in combination. Among them, hydrophobic silica is preferred since it can impart sufficient flowability to the toner.

—Magnetic Material—

The magnetic material is not particularly limited and may be appropriately selected depending on the intended purpose. Examples thereof include: ferromagnetic materials such as iron and cobalt; and magnetic materials such as magnetite, hematite, Li ferrite, Mn—Zn ferrite, Cu—Zn ferrite, Ni—Zn ferrite and Ba ferrite.

—Colorant—

The colorant is not particularly limited and may be appropriately selected depending on the intended purpose. Examples thereof include iron black, ultramarine, carbon black, Lamp black, Hansa yellow G, rhodamine 6G lake, quinacridone, benzidine yellow, chrome yellow, rose bengal, Calco Oil Blue, aniline blue, phthalocyanine blue, monoazo pigments, triarylmethane dye, nigrosine dye, disazo dye and dyeing pigments. These may be used alone or in combination.

<<Method for Producing the Toner>>

A method for producing the toner is, for example, a method where the charge-controlling agent, the releasing agent and the other ingredients are incorporated into the binder resin and the resultant mixture is treated by, for example, a conventionally known polymerization method or granulation method to thereby produce deformed or spherical toner particles.

The toner produced by the above toner production method may be a magnetic or non-magnetic toner, or a color toner or a transparent toner.

The magnetic toner is a toner containing the magnetic material.

The non-magnetic toner is a toner containing no magnetic material.

The color toner is a toner containing the colorant.

The transparent toner is a toner containing no colorant.

—Weight Average Particle Diameter Dw of Toner—

The weight average particle diameter Dw of the toner refers to a particle diameter at an integrated value of 50% in a particle size distribution of the toner measured by the laser diffraction/scattering method. The weight average particle diameter Dw of the toner is not particularly limited and may be appropriately selected depending on the intended purpose, but is preferably 3.0 μm to 9.0 μm, more preferably 3.0 μm to 6.0 μm.

The weight average particle diameter Dw of the toner was measured with COULTER MULTISIZER III (product of BECKMAN COULTER Co.).

<Method for Producing the Developer>

The method for producing the developer is not particularly limited and may be appropriately selected depending on the intended purpose. Examples thereof include a method where the above-described latent electrostatic image developing carrier and the above-described toner are mixed together and stirred with a turbular mixer to thereby produce the developer.

(Developer-Housing Container)

A developer-housing container of the present invention includes: a container; and a developer housed in the container, wherein the developer contains the above-described latent electrostatic image developing carrier of the present invention and the above-described toner.

The above developer housing container can be easily stored and transported and is excellent in handleability. It can suitably be used for the supply of a developer when detachably mounted to the below-described process cartridge.

The container of the developer-housing container is not particularly limited and may use a conventionally known container depending on the intended purpose. For example, the container has a container main body and a cap.

The size, shape, structure and material of the container main body are not particularly limited and may be appropriately selected depending on the intended purpose. Regarding the size thereof, it is preferred that high dimensional accuracy is obtained. The shape thereof is preferably a hollow-cylindrical shape. The structure thereof is preferably a structure whose inner surface has spirally-arranged concavo-convex portions some or all of which can accordion and in which the developer accommodated can be transferred to an outlet port through rotation. The material is preferably a polyester resin, a polyethylene resin, a polypropylene resin, a polystyrene resin, a polyvinyl chloride resin, a polyacrylic acid resin, a polycarbonate resin, an ABS resin and a polyacetal resin.

The size, shape, structure and material of the cap are not particularly limited and may be appropriately selected depending on the intended purpose.

(Replenishing Developer)

A replenishing developer contains the above-described latent electrostatic image developing carrier of the present invention and the above-described toner. The replenishing developer can be applied to an image forming apparatus which performs image formation while discharging excess developer from the developing device. The developing device using the replenishing developer can attain steady image quality for a very long period of time. Specifically, in the image forming apparatus using the above replenishing developer, the degraded carrier in the developing device is exchanged to unused carrier in the replenishing developer. As a result, it is possible to keep the charge amount stable for a long period of time, leading to stable image formation. This method is particularly advantageous in printing an image having a large image occupation area. The degradation during printing of the image having a large image occupation area is caused due to degradation of the carrier which is mainly reduction in charging performance of the carrier resulting from toner spent on the carrier. However, with this method, the degraded carrier is exchanged more frequently in printing an image having a large image occupation area, since the amount of the carrier replenished becomes large in this case.

The replenishing developer is not particularly limited and may be appropriately selected depending on the intended purpose, so long as it contains the above toner in an amount of 2 parts by mass to 50 parts by mass per 1 part by mass of the latent electrostatic image developing carrier. The replenishing developer preferably contains the above toner in an amount of 5 parts by mass to 20 parts by mass per 1 part by mass of the latent electrostatic image developing carrier. When the toner is contained in the replenishing developer in an amount of 2 parts by mass or less per 1 part by mass of the latent electrostatic image developing carrier, the amount of the carrier replenished becomes so large that the carrier is excessively supplied. As a result, the concentration of the carrier in the developing device becomes so high that the charge amount of the toner may increase. In addition, when the charge amount of the toner increases, the toner decreases in developing capability to potentially reduce the image density. When the toner is contained in the replenishing developer in an amount of 50 parts by mass or more per 1 part by mass of the latent electrostatic image developing carrier, the amount of the carrier in the replenishing developer becomes small, and the carrier in the image forming apparatus is exchanged less frequently, so that the effects of improving the carrier degradation cannot expected in some cases.

(Process Cartridge)

A process cartridge of the present invention includes; a latent electrostatic image bearing member; and a developing unit configured to develop a latent electrostatic image on the latent electrostatic image bearing member with a developer containing the above-described latent electrostatic image developing carrier of the present invention and a toner, wherein the latent electrostatic image bearing member is supported integrally with the developing unit.

An embodiment of the process cartridge of the present invention will be described with reference to FIG. 1.

As illustrated in FIG. 1, a process cartridge 10 includes: a latent electrostatic image bearing member 11; a charging device 12 configured to charge the latent electrostatic image bearing member; a developing device 13 configured to develop a latent electrostatic image on the latent electrostatic image bearing member with the developer of the present invention, to thereby form a toner image; and a cleaning device 14 configured to remove the toner remaining on the latent electrostatic image bearing member after the toner image has been transferred from the latent electrostatic image bearing member to a recording medium. The process cartridge is detachably mountable to a main body of an image forming apparatus such as a copier and a printer.

(Image Forming Apparatus and Image Forming Method)

An image forming apparatus of the present invention includes: a unit configured to form a latent electrostatic image on a latent electrostatic image bearing member; a unit configured to develop the latent electrostatic image on the latent electrostatic image bearing member with a developer containing the above-described latent electrostatic image developing carrier of the present invention and a toner, to thereby form a toner image; a unit configured to transfer the toner image from the latent electrostatic image bearing member to a recording medium; and a unit configured to fix the toner image transferred on the recording medium. The unit configured to develop the latent electrostatic image is not particularly limited and may be appropriately selected depending on the intended purpose, but is preferably a unit configured to develop the latent electrostatic image with the developer in which magnetic brushes are formed, to thereby form a toner image.

The image forming method includes: a step of forming a latent electrostatic image on a latent electrostatic image bearing member; a step of developing a latent electrostatic image on the latent electrostatic image bearing member with a developer containing the above-described latent electrostatic image developing carrier of the present invention and a toner, to thereby form a toner image; a step of transferring the toner image from the latent electrostatic image bearing member to a recording medium; and a step of fixing the toner image transferred on the recording medium. The step of developing the latent electrostatic image is not particularly limited and may be appropriately selected depending on the intended purpose, but is preferably a unit configured to develop the latent electrostatic image with the developer in which magnetic brushes are formed, to thereby form a toner image.

An embodiment of the image forming apparatus of the present invention will be described with reference to FIG. 2.

Figure 2:
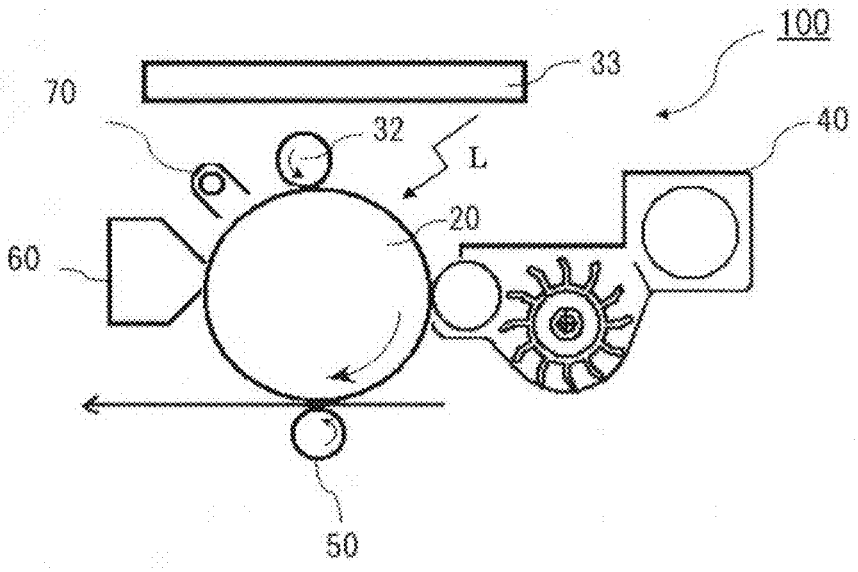
FIG. 2 illustrates one exemplary image forming apparatus of the present invention.

As illustrated in FIG. 2, first, a latent electrostatic image bearing member 20 is rotated at a predetermined circumferential velocity, and the surface of the latent electrostatic image bearing member 20 is uniformly charged to a predetermined positive or negative potential with a charging device 32. Next, the surface of the latent electrostatic image bearing member 20 is exposed to laser light emitted from an exposing device 33 (denoted by "L" in FIG. 2) to thereby form a latent electrostatic images. Furthermore, the latent electrostatic image on the surface of the latent electrostatic image bearing member 20 is developed by a developing device 40 with a developer containing the latent electrostatic image developing carrier of the present invention and a toner, to thereby form a toner image. Next, the toner image formed on the surface of the latent electrostatic image bearing member 20 is transferred onto a recording paper sheet that is fed from a paper supplier to in between the latent electrostatic image bearing member 20 and a transfer device 50, in synchronization with the rotation of the latent electrostatic image bearing member 20. The recording paper sheet onto which the toner image has been transferred is separated from the surface of the latent electrostatic image bearing member 20 and introduced into a fixing device so as to fix the image thereon. Thereafter, the resultant product is printed out from the image forming device 100 as a copy. The surface of the latent electrostatic image bearing member 20 from which the toner image has been transferred is cleaned by a cleaning device 60 so as to remove the toner remaining after the transfer, and is charge-eliminated by a charge-eliminating device 70 and repeatedly used for image formation.

EXAMPLES

The present invention will next be described in detail by way of Examples and Comparative Examples. However, the present invention should not be construed as being limited to the Examples. Notably, the shape factor SF-1, the shape factor SF-2, the weight average particle diameter and the arithmetic mean surface roughness Ra of core particles, the number average particle diameter and the powder specific resistance of a filler, the shape factor SF-2 and the bulk density of a carrier, and the weight average particle diameter of a toner measured in Examples and Comparative Examples are those measured by the above-described measurement methods.

Core Particles Production Example 1

Production of Core Particles 1

$MnCO_3$ powder, $Mg(OH)_2$ powder and $Fe_2O_3$ powder were weighed and mixed together to obtain a powder mixture. The powder mixture was calcined with a heating furnace at 900° C. for 3 hours in an atmosphere. The thus-calcined product was cooled and then pulverized to form powder having a weight average particle diameter of 7 μm. A dispersing agent (1% by mass) and water were added to the formed powder to prepare slurry, which was fed to a spray dryer for granulation to obtain a granulated product having a weight average particle diameter of about 40 μm. The granulated product was charged to a firing furnace, where the granulated product was fired in a nitrogen atmosphere at 1,250° C. for 5 hours. The fired product was milled with a mill and sieved for controlling the grain size, to thereby obtain [core particles 1] (spherical ferrite particles) having a weight average particle diameter of about 35 μm. The [core particles 1] were analyzed for composition and were found to be MnO (46.2 mol %), MgO (0.7 mol %) and $Fe_2O_3$ (53 mol %). Also, the [core particles 1] were found to have a SF-1 of 140, a SF-2 of 145, and an Ra of 0.7 μm.

Core Particles Production Example 2

Production of Core Particles 2

In the same manner as in Core Particles Production Example 1, the powder mixture was calcined and the calcined product was cooled and then pulverized to form powder having a weight average particle diameter of 3%n. A dispersing agent (1% by mass) and water were added to the formed powder to prepare slurry, which was fed to a spray dryer for granulation to obtain a granulated product having a weight average particle diameter of about 40 μm. The granulated product was charged to a firing furnace, where the granulated product was fired in a nitrogen atmosphere at 1,200° C. for 5 hours. The fired product was milled with a mill and sieved for controlling the grain size, to thereby obtain [core particles 2] (spherical ferrite particles) having a weight average particle diameter of about 35 μm. The [core particles 2] were found to have a SF-1 of 130, a SF-2 of 152, and an Ra of 0.93 μm.

Core Particles Production Example 3

Production of Core Particles 3

In the same manner as in Core Particles Production Example 1, the powder mixture was calcined and the calcined product was cooled and then pulverized to form powder having a weight average particle diameter of 1 μm. A dispersing agent (1% by mass) and water were added to the formed powder to prepare slurry, which was fed to a spray dryer for granulation to obtain a granulated product having a weight average particle diameter of about 40 μm. The granulated product was charged to a firing furnace, where the granulated product was fired in a nitrogen atmosphere at 1,300° C. for 5 hours. The fired product was milled with a mill and sieved for controlling the grain size, to thereby obtain [core particles 3] (spherical ferrite particles) having a weight average particle diameter of about 35 μm. The [core particles 3] were found to have a SF-1 of 125, a SF-2 of 119, and an Ra of 0.45 μm.

Core Particles Production Example 4

Production of Core Particles 4

In the same manner as in Core Particles Production Example 1, the powder mixture was calcined and the calcined product was cooled and then pulverized to form powder having a weight average particle diameter of 1 μm. A dispersing agent (1% by mass) and water were added to the formed powder to prepare slurry, which was fed to a spray dryer for granulation to obtain a granulated product having a weight average particle diameter of about 40 μm. The granulated product was charged to a firing furnace, where the granulated product was fired in a nitrogen atmosphere at 1,050° C. for 5 hours. The fired product was milled with a mill and sieved for controlling the grain size, to thereby obtain [core particles 4] (spherical ferrite particles) having a weight average particle diameter of about 35 μm. The [core particles 4] were found to have a SF-1 of 130, a SF-2 of 125, and an Ra of 0.75 μm.

Core Particles Production Example 5

Production of Core Particles 5

$MnCO_3$ powder, $Mg(OH)_2$ powder, $Fe_2O_3$ powder and $SrCO_3$ powder were weighed and mixed together to obtain a powder mixture. The powder mixture was calcined with a heating furnace at 850° C. for 1 hour in an atmosphere. The thus-calcined product was cooled and then pulverized to form powder having a weight average particle diameter of 3 μm or less. A dispersing agent (1% by mass) and water were added to the formed powder to prepare slurry, which was fed to a spray dryer for granulation to obtain a granulated product having a weight average particle diameter of about 40 μm. The granulated product was charged to a firing furnace, where the granulated product was fired in a nitrogen atmosphere at 1,120° C. for 4 hours. The fired product was milled with a mill and sieved for controlling the grain size, to thereby obtain [core particles 5] (spherical ferrite particles) having a weight average particle diameter of about 35 nm. The [core particles 5] were analyzed for composition and were found to be MnO (40.0 mol %), MgO (10.0 mol %), $Fe_2O_3$ (50.0 mol %) and SrO (0.4 mol %). Also, the [core particles 5] were found to have a SF-1 of 145, a SF-2 of 155, and an Ra of 0.85 μm.

Core Particles Production Example 6

Production of Core Particles 6

In the same manner as in Core Particles Production Example 4, the powder mixture was calcined and the calcined product was cooled and then pulverized to form powder having a weight average particle diameter of 1 μm. A dispersing agent (1% by mass) and water were added to the formed powder to prepare slurry, which was fed to a spray dryer for granulation to obtain a granulated product having a weight average particle diameter of about 40 μm. The granulated product was charged to a firing furnace, where the granulated product was fired in a nitrogen atmosphere at 1,180° C. for 4 hours. The fired product was milled with a mill and sieved for controlling the grain size, to thereby obtain [core particles 6] (spherical ferrite particles) having a weight average particle diameter of about 35 μm. The [core particles 6] were found to have a SF-1 of 135, a SF-2 of 122, and an Ra of 0.63 μm.

Core Particles Production Example 7

Production of Core Particles 7

In the same manner as in Core Particles Production Example 4, the powder mixture was calcined and the calcined product was cooled and then pulverized to form powder having a weight average particle diameter of 1 μm. A dispersing agent (1% by mass) and water were added to the formed powder to prepare slurry, which was fed to a spray dryer for granulation to obtain a granulated product having a weight average particle diameter of about 40 μm. The granulated product was charged to a firing furnace, where the granulated product was fired in a nitrogen atmosphere at 1,080° C. for 4 hours. The fired product was milled with a mill and sieved for controlling the grain size, to thereby obtain [core particles 7] (spherical ferrite particles) having a weight average particle diameter of about 35 μm. The [core particles 7] were found to have a SF-1 of 150, a SF-2 of 165, and an Ra of 1.03 μm.

Core Particles Production Example 8

Production of Core Particles 8

$MnCO_3$ powder, $Mg(OH)_2$ powder, $Fe_2O_3$ powder and $CaCO_3$ powder were weighed and mixed together to obtain a powder mixture. The powder mixture was calcined with a heating furnace at 850° C. for 1 hour in an atmosphere. The thus-calcined product was cooled and then pulverized to form powder having a weight average particle diameter of 3 μm or less. A dispersing agent (1% by mass) and water were added to the formed powder to prepare slurry, which was fed to a spray dryer for granulation to obtain a granulated product having a weight average particle diameter of about 40 μm. The granulated product was charged to a firing furnace, where the granulated product was fired in a nitrogen atmosphere at 1,200° C. for 5 hours. The fired product was milled with a mill and sieved for controlling the grain size, to thereby obtain [core particles 8] (spherical ferrite particles) having a weight average particle diameter of about 35 μm. The [core particles 8] were analyzed for composition and were found to be MnO (44.3 mol %), MgO (0.7 mol %), $Fe_2O_3$ (53 mol %) and CaO (2.0 mol %). Also, the [core particles 8] were found to have a SF-1 of 130, a SF-2 of 140, and an Ra of 0.68 μm.

Filler Production Example 1

Production of Electroconductive Filler 1

Aluminum oxide (AKP-30, product of Sumitomo Chemical Co., Ltd.) (100 g) was dispersed in water (1 L) and the obtained suspension was heated to 70° C. Next, 12% by mass aqueous ammonia and a solution of tin(II) chloride (100 g) and phosphorus pentoxide (3 g) dissolved in 2N hydrochloric acid (1 L) were added dropwise to the suspension for 2 hours so that the pH thereof became 7 to 8. After this dropwise addition, the suspension was filtrated and washed to obtain a cake, which was then dried at 110° C. This dry powder was treated under nitrogen flow at 500° C. for 1 hour to obtain [electroconductive filler 1]. The obtained [electroconductive filler 1] was found to have a number average particle diameter of 400 nm and a powder specific resistance of 50 Ω·cm.

Filler Production Example 2

Production of Non-Electroconductive Filler 2

Aluminum oxide (AKP-30, product of Sumitomo Chemical Co., Ltd.) (100 g) was dispersed in water (1 L) and the obtained suspension was heated to 70° C. Next, 12% by mass aqueous ammonia and a solution of tin(II) chloride (10 g) and phosphorus pentoxide (0.30 g) dissolved in 2N hydrochloric acid (100 mL) were added dropwise to the suspension for 12 min so that the pH thereof became 7 to 8. After this dropwise addition, the suspension was filtrated and washed to obtain a cake, which was then dried at 110° C. This dry powder was treated under nitrogen flow at 500° C. for 1 hour to obtain [non-electroconductive filler 2]. The obtained [non-electroconductive filler 2] was found to have a number average particle diameter of 300 nm and a powder specific resistance of 1,200 Ω·cm.

Filler Production Example 3

Production of Electroconductive Filler 3

Aluminum oxide (AKP-30, product of Sumitomo Chemical Co., Ltd.) (100 g) was dispersed in water (1 L) and the obtained suspension was heated to 70° C. Next, 12% by mass aqueous ammonia and a solution of tin(II) chloride (150 g) and phosphorus pentoxide (4.5 g) dissolved in 2N hydrochloric acid (1.5 L) were added dropwise to the suspension for 3 hours so that the pH thereof became 7 to 8. After this dropwise addition, the suspension was filtrated and washed to obtain a cake, which was then dried at 110° C. This dry powder was treated under nitrogen flow at 500° C. for 1 hour to obtain [electroconductive filler 3]. The obtained [electroconductive filler 3] was found to have a number average particle diameter of 600 nm and a powder specific resistance of 10 Ω·cm.

Filler Production Example 4

Production of Electroconductive Filler 4

Aluminum oxide (AKP-30, product of Sumitomo Chemical Co., Ltd.) (100 g) was dispersed in water (1 L) and the obtained suspension was heated to 70° C. Next, 12% by mass aqueous ammonia and a solution of tin(II) chloride (11.6 g) dissolved in 2N hydrochloric acid (1 L) were added dropwise to the suspension for 40 min so that the pH thereof became 7 to 8. After this dropwise addition, the suspension was filtrated and washed to obtain a cake, which was then dried at 110° C. This dry powder was treated under nitrogen flow at 500° C. for 1 hour to obtain [electroconductive filler 4]. The obtained [electroconductive filler 4] was found to have a number average particle diameter of 300 nm and a powder specific resistance of 4 Ω·cm.

Filler Production Example 5

Production of Electroconductive Filler 5

Rutile-type titanium oxide (KR-310, Titan Kogyo, Ltd.) (100 g) was dispersed in water (1 L) and the obtained suspension was heated to 70° C. Next, 12% by mass aqueous ammonia and a solution of tin(II) chloride (100 g) and phosphorus pentoxide (3 g) dissolved in 2N hydrochloric acid (1 L) were added dropwise to the suspension for 2 hours so that the pH thereof became 7 to 8. After this dropwise addition, the suspension was filtrated and washed to obtain a cake, which was then dried at 110° C. This dry powder was treated under nitrogen flow at 500° C. for 1 hour to obtain [electroconductive filler 5]. The obtained [electroconductive filler 5] was found to have a number average particle diameter of 450 nm and a powder specific resistance of 40 Ω·cm.

Resin Synthesis Example 1

Synthesis of Resin 1

Toluene (300 g) was charged to a flask equipped with a stirrer and increased in temperature to 90° C. under nitrogen gas flow. Next, a mixture of 3-methacryloxypropyltris(trimethylsiloxane)silane (SYLAPLANE TM-0701T, product of Chisso Corporation) (84.4 g, 200 mmol), 3-methacryloxypropylmethyldiethoxysilane (39 g, 150 mmol), methyl methacrylate (65.0 g, 650 mmol) and 2,2'-azobis-2-methylbutylonitrile (0.58 g, 3 mmol) was added dropwise thereto for 1 hour. After this dropwise addition, a solution of 2,2'-azobis-2-methylbutylonitrile (0.06 g, 0.3 mmol) dissolved in toluene (15 g) was further added thereto (the total amount of 2,2'-azobis-2-methylbutylonitrile: 0.64 g, 3.3 mmol), followed by mixing for 3 hours at 90° C. to 100° C. to perform radical copolymerization, to thereby obtain [resin 1]. The obtained [resin 1] was found to have a weight average molecular weight of 33,000. Next, the [resin 1] was diluted with toluene so that the non-volatile content became 25% by mass. The thus-obtained 25% by mass solution of the [resin 1] was found to have a viscosity of 8.8 $mm^2/s$ and a specific gravity of 0.91.

Resin Synthesis Example 2

Synthesis of Resin 2

[Resin 2] was obtained in the same manner as in Resin Synthesis Example 1 except that the 3-methacryloxypropylmethyldiethoxysilane was changed to 3-methacryloxypropyltrimethoxysilane (37.2 g, 150 mmol) to perform radical copolymerization. The obtained [resin 2] was found to have a weight average molecular weight of 34,000. Next, the [resin 2] was diluted with toluene so that the non-volatile content became 25% by mass. The thus-obtained 25% by mass solution of the [resin 2] was found to have a viscosity of 8.7 $mm^2/s$ and a specific gravity of 0.91.

Example 1

Production of latent electrostatic image developing carrier A)

[Coating layer forming solution A] (solid content: 10% by mass) having the following composition was prepared to form a coating layer of latent electrostatic image developing carrier A. The [core particles 1] (1,000 parts by mass) were coated with the [coating layer forming solution A] and dried. Here, the coating and the drying were performed using a fluidized-bed coating apparatus the fluidized vessels of which had been each controlled to 70° C. The obtained carrier was fired in an electric furnace at 180° C. for 2 hours to obtain [carrier A]. The properties of the [carrier A] are shown in Table 1.

[Composition of Coating Layer Forming Solution A]

Resin for coating layer (silicone resin): 80 parts by mass (methylsilicone resin produced from a difunctional or trifunctional monomer)
(weight average molecular weight: 15,000, solid content: 25% by mass)

Electroconductive filler 1 (Filler Production Example 1): 56 parts by mass

Catalyst: 4 parts by mass
(diisopropoxybis(ethylacetoacetate)titanium)
(ORGATIX TC-750, product of Matsumoto Fine Chemical Co., Ltd.)

Silane coupling agent: 0.6 parts by mass
(SH6020, product of Dow Corning Toray Co., Ltd.)

Toluene: balance

Example 2

Production of Latent Electrostatic Image Developing Carrier B

[Coating layer forming solution B] (solid content: 10% by mass) having the following composition was prepared to form a coating layer of latent electrostatic image developing carrier B. The [core particles 1] (1,000 parts by mass) were coated with the [coating layer forming solution B] and dried. Here, the coating and the drying were performed using a fluidized-bed coating apparatus the fluidized vessels of which had been each controlled to 70° C. The obtained carrier was fired in an electric furnace at 180° C. for 2 hours to obtain [carrier B]. The properties of the [carrier B] are shown in Table 1.

[Composition of Coating Layer Forming Solution B]

Resin for coating layer (silicone resin): 44 parts by mass (methylsilicone resin produced from a difunctional or trifunctional monomer)
(weight average molecular weight: 15,000, solid content: 25% by mass)

Electroconductive filler 4 (Filler Production Example 4): 22 parts by mass

Catalyst: 2 parts by mass
(diisopropoxybis(ethylacetoacetate)titanium)
(ORGATIX TC-750, product of Matsumoto Fine Chemical Co., Ltd.)

Silane coupling agent: 0.3 parts by mass
(SH6020, product of Dow Corning Toray Co., Ltd.)

Toluene: balance

Example 3

Production of Latent Electrostatic Image Developing Carrier C

[Coating layer forming solution C] (solid content: 10% by mass) having the following composition was prepared to form a coating layer of latent electrostatic image developing carrier C. The [core particles 1] (1,000 parts by mass) were coated with the [coating layer forming solution C] and dried. Here, the coating and the drying were performed using a fluidized-bed coating apparatus the fluidized vessels of which had been each controlled to 70° C. The obtained carrier was fired in an electric furnace at 180° C. for 2 hours to obtain [carrier C]. The properties of the [carrier C] are shown in Table 1.

[Composition of Coating Layer Forming Solution C]

Resin for coating layer (silicone resin): 30 parts by mass (methylsilicone resin produced from a difunctional or trifunctional monomer)
(weight average molecular weight: 15,000, solid content: 25% by mass)

Resin for coating layer (resin 1 of Resin Synthesis Example 1, solid content: 25% by mass): 30 parts by mass Electroconductive filler 4 (Filler Production Example 4): 15 parts by mass Catalyst: 3 parts by mass (diisopropoxybis(ethylacetoacetate)titanium)

(ORGATIX TC-750, product of Matsumoto Fine Chemical Co., Ltd.)

Silane coupling agent: 0.5 parts by mass (SH6020, product of Dow Corning Toray Co., Ltd.)

Toluene: balance

Example 4

Production of Latent Electrostatic Image Developing Carrier D

[Coating layer forming solution D] (solid content: 10% by mass) having the following composition was prepared to form a coating layer of latent electrostatic image developing carrier D. The [core particles 1] (1,000 parts by mass) were coated with the [coating layer forming solution D] and dried. Here, the coating and the drying were performed using a fluidized-bed coating apparatus the fluidized vessels of which had been each controlled to 70° C. The obtained carrier was fired in an electric furnace at 180° C. for 2 hours to obtain [carrier D]. The properties of the [carrier D] are shown in Table 1.

[Composition of Coating Layer Forming Solution D]

Resin for coating layer (silicone resin): 64 parts by mass (methylsilicone resin produced from a difunctional or trifunctional monomer)

(weight average molecular weight: 15,000, solid content: 25% by mass)

Resin for coating layer (resin 2 of Resin Synthesis Example 2, solid content: 25% by mass): 16 parts by mass Electroconductive filler 4 (Filler Production Example 4): 56 parts by mass Catalyst: 4 parts by mass (diisopropoxybis(ethylacetoacetate)titanium)

(ORGATIX TC-750, product of Matsumoto Fine Chemical Co., Ltd.)

Silane coupling agent: 0.6 parts by mass (SH6020, product of Dow Corning Toray Co., Ltd.)

Toluene: balance

Example 5

Production of Latent Electrostatic Image Developing Carrier E)

[Coating layer forming solution E] (solid content: 10% by mass) having the following composition was prepared to form a coating layer of latent electrostatic image developing carrier E. The [core particles 1] (1,000 parts by mass) were coated with the [coating layer forming solution E] and dried. Here, the coating and the drying were performed using a fluidized-bed coating apparatus the fluidized vessels of which had been each controlled to 70° C. The obtained carrier was fired in an electric furnace at 180° C. for 2 hours to obtain [carrier E]. The properties of the [carrier E] are shown in Table 1.

[Composition of Coating Layer Forming Solution E]

Resin for coating layer (silicone resin): 42 parts by mass (methylsilicone resin produced from a difunctional or trifunctional monomer)

(weight average molecular weight: 15,000, solid content: 25% by mass)

Resin for coating layer (resin 1 of Resin Synthesis Example 1, solid content: 25% by mass): 2 parts by mass Electroconductive filler 3 (Filler Production Example 3): 30 parts by mass Catalyst: 3 parts by mass (diisopropoxybis(ethylacetoacetate)titanium)

(ORGATIX TC-750, product of Matsumoto Fine Chemical Co., Ltd.)

Silane coupling agent: 0.3 parts by mass (SH6020, product of Dow Corning Toray Co., Ltd.)

Toluene: balance

Example 6

Production of Latent Electrostatic Image Developing Carrier F

[Coating layer forming solution F] (solid content: 10% by mass) having the following composition was prepared to form a coating layer of latent electrostatic image developing carrier F. The [core particles 1] (1,000 parts by mass) were coated with the [coating layer forming solution E] and dried. Here, the coating and the drying were performed using a fluidized-bed coating apparatus the fluidized vessels of which had been each controlled to 70° C. The obtained carrier was fired in an electric furnace at 180° C. for 2 hours to obtain [carrier F]. The properties of the [carrier F] are shown in Table 1.

[Composition of Coating Layer Forming Solution F]

Resin for coating layer (silicone resin): 74 parts by mass (methylsilicone resin produced from a difunctional or trifunctional monomer)

(weight average molecular weight: 15,000, solid content: 25% by mass)

Resin for coating layer (resin 1 of Resin Synthesis Example 1, solid content: 25% by mass): 18 parts by mass Non-electroconductive filler 2 (Filler Production Example 2): 50 parts by mass Electroconductive filler (containing barium sulfate): 46.6 parts by mass (PASTRAN4310, product of MITSUI MINING & SMELTING CO., LTD.)

(average particle diameter: 150 nm, volume specific resistance: 12 Ω·cm)

Catalyst: 4 parts by mass (diisopropoxybis(ethylacetoacetate)titanium)

(ORGATIX TC-750, product of Matsumoto Fine Chemical Co., Ltd.)

Silane coupling agent: 7 parts by mass (SH6020, product of Dow Corning Toray Co., Ltd.)

Toluene: balance

Example 7

Production of Latent Electrostatic Image Developing Carrier G

[Coating layer forming solution G] (solid content: 10% by mass) having the following composition was prepared to form a coating layer of latent electrostatic image developing carrier G. The [core particles 1] (1,000 parts by mass) were coated with the [coating layer forming solution G] and dried. Here, the coating and the drying were performed using a fluidized-bed coating apparatus the fluidized vessels of which had been each controlled to 70° C. The obtained carrier was fired in an electric furnace at 180° C. for 2 hours to obtain [carrier G]. The properties of the [carrier G] are shown in Table 1.

[Composition of Coating Layer Forming Solution G]

Resin for coating layer (resin 2 of Resin Synthesis Example 2, solid content: 25% by mass): 48 parts by mass Electroconductive filler 1 (Filler Production Example 1): 18 parts by mass Electroconductive filler (carbon black): 1 part by mass (REGAL330, product of Cabot Corporation) (average particle diameter: 25 nm, volume specific resistance: 0.1 Ω·cm)

Catalyst: 2 parts by mass (diisopropoxybis(ethylacetoacetate)titanium) (ORGATIX TC-750, product of Matsumoto Fine Chemical Co., Ltd.)

Silane coupling agent: 0.4 parts by mass (SH6020, product of Dow Corning Toray Co., Ltd.)

Toluene: balance

Example 8

Production of Latent Electrostatic Image Developing Carrier H

[Coating layer forming solution H] (solid content: 10% by mass) having the following composition was prepared to form a coating layer of latent electrostatic image developing carrier H. The [core particles 2] (1,000 parts by mass) were coated with the [coating layer forming solution H] and dried. Here, the coating and the drying were performed using a fluidized-bed coating apparatus the fluidized vessels of which had been each controlled to 70° C. The obtained carrier was fired in an electric furnace at 180° C. for 2 hours to obtain [carrier H]. The properties of the [carrier H] are shown in Table 1.

[Composition of Coating Layer Forming Solution H]

Resin for coating layer (silicone resin): 60 parts by mass (methylsilicone resin produced from a difunctional or trifunctional monomer) (weight average molecular weight: 15,000, solid content: 25% by mass)

Electroconductive filler 4 (Filler Production Example 4): 38 parts by mass

Catalyst: 3 parts by mass (diisopropoxybis(ethylacetoacetate)titanium) (ORGATIX TC-750, product of Matsumoto Fine Chemical Co., Ltd.)

Silane coupling agent: 0.5 parts by mass (SH6020, product of Dow Corning Toray Co., Ltd.)

Toluene: balance

Example 9

Production of Latent Electrostatic Image Developing Carrier I

[Coating layer forming solution I] (solid content: 10% by mass) having the following composition was prepared to form a coating layer of latent electrostatic image developing carrier I. The [core particles 5] (1,000 parts by mass) were coated with the [coating layer forming solution I] and dried. Here, the coating and the drying were performed using a fluidized-bed coating apparatus the fluidized vessels of which had been each controlled to 70° C. The obtained carrier was fired in an electric furnace at 180° C. for 2 hours to obtain [carrier I]. The properties of the [carrier I] are shown in Table 1.

[Composition of Coating Layer Forming Solution I]

Resin for coating layer (silicone resin): 24 parts by mass (methylsilicone resin produced from a difunctional or trifunctional monomer) (weight average molecular weight: 15,000, solid content: 25% by mass)

Electroconductive filler (containing barium sulfate): 7 parts by mass (PASTRAN4310, product of MITSUI MINING & SMELTING CO., LTD.) (average particle diameter: 150 nm, volume specific resistance: 12 Ω·cm)

Catalyst: 1 part by mass (diisopropoxybis(ethylacetoacetate)titanium) (ORGATIX TC-750, product of Matsumoto Fine Chemical Co., Ltd.)

Silane coupling agent: 0.2 parts by mass (SH6020, product of Dow Corning Toray Co., Ltd.)

Toluene: balance

Example 10

Production of Latent Electrostatic Image Developing Carrier J

[Coating layer forming solution J] (solid content: 10% by mass) having the following composition was prepared to form a coating layer of latent electrostatic image developing carrier J. The [core particles 5] (1,000 parts by mass) were coated with the [coating layer forming solution J] and dried. Here, the coating and the drying were performed using a fluidized-bed coating apparatus the fluidized vessels of which had been each controlled to 70° C. The obtained carrier was fired in an electric furnace at 180° C. for 2 hours to obtain [carrier J]. The properties of the [carrier J] are shown in Table 1.

[Composition of Coating Layer Forming Solution J]

Resin for coating layer (silicone resin): 112 parts by mass (methylsilicone resin produced from a difunctional or trifunctional monomer) (weight average molecular weight: 15,000, solid content: 25% by mass)

Electroconductive filler 4 (Filler Production Example 4): 100 parts by mass

Non-electroconductive filler 2 (Filler Production Example 2): 6 parts by mass

Catalyst: 6 parts by mass (diisopropoxybis(ethylacetoacetate)titanium) (ORGATIX TC-750, product of Matsumoto Fine Chemical Co., Ltd.)

Silane coupling agent: 1.0 part by mass (SH6020, product of Dow Corning Toray Co., Ltd.)

Toluene: balance

Example 11

Production of Latent Electrostatic Image Developing Carrier K)

[Coating layer forming solution K] (solid content: 10% by mass) having the following composition was prepared to form a coating layer of latent electrostatic image developing carrier K. The [core particles 5] (1,000 parts by mass) were coated with the [coating layer forming solution K] and dried. Here, the coating and the drying were performed using a fluidized-bed coating apparatus the fluidized vessels of which had been each controlled to 70° C. The obtained carrier was fired in an electric furnace at 180° C. for 2 hours to obtain [carrier K]. The properties of the [carrier K] are shown in Table 1.

[Composition of Coating Layer Forming Solution K]

Resin for coating layer (silicone resin): 12 parts by mass (methylsilicone resin produced from a difunctional or trifunctional monomer)

(weight average molecular weight: 15,000, solid content: 25% by mass)

Resin for coating layer (resin 2 of Resin Synthesis Example 2, solid content: 25% by mass): 48 parts by mass Electroconductive filler 4 (Filler Production Example 4): 38 parts by mass Catalyst: 1 part by mass (diisopropoxybis(ethylacetoacetate)titanium)

(ORGATIX TC-750, product of Matsumoto Fine Chemical Co., Ltd.)

Silane coupling agent: 0.5 parts by mass (SH6020, product of Dow Corning Toray Co., Ltd.)

Toluene: balance

Example 12

Production of Latent Electrostatic Image Developing Carrier L

[Coating layer forming solution L] (solid content: 10% by mass) having the following composition was prepared to form a coating layer of latent electrostatic image developing carrier L. The [core particles 5] (1,000 parts by mass) were coated with the [coating layer forming solution L] and dried. Here, the coating and the drying were performed using a fluidized-bed coating apparatus the fluidized vessels of which had been each controlled to 70° C. The obtained carrier was fired in an electric furnace at 180° C. for 2 hours to obtain [carrier L]. The properties of the [carrier L] are shown in Table 1.

[Composition of Coating Layer Forming Solution L]

Resin for coating layer (silicone resin): 22 parts by mass (methylsilicone resin produced from a difunctional or trifunctional monomer)

(weight average molecular weight: 15,000, solid content: 25% by mass)

Resin for coating layer (resin 1 of Resin Synthesis Example 1, solid content: 25% by mass): 22 parts by mass Electroconductive filler 3 (Filler Production Example 3): 22 parts by mass Catalyst: 2 parts by mass (diisopropoxybis(ethylacetoacetate)titanium)

(ORGATIX TC-750, product of Matsumoto Fine Chemical Co., Ltd.)

Silane coupling agent: 0.3 parts by mass (SH6020, product of Dow Corning Toray Co., Ltd.)

Toluene: balance

Example 13

Production of Latent Electrostatic Image Developing Carrier M

[Coating layer forming solution M] (solid content: 10% by mass) having the following composition was prepared to form a coating layer of latent electrostatic image developing carrier M. The [core particles 5] (1,000 parts by mass) were coated with the [coating layer forming solution M] and dried. Here, the coating and the drying were performed using a fluidized-bed coating apparatus the fluidized vessels of which had been each controlled to 70° C. The obtained carrier was fired in an electric furnace at 180° C. for 2 hours to obtain [carrier M]. The properties of the [carrier M] are shown in Table 1.

[Composition of Coating Layer Forming Solution M]

Resin for coating layer (silicone resin): 28 parts by mass (methylsilicone resin produced from a difunctional or trifunctional monomer)

(weight average molecular weight: 15,000, solid content: 25% by mass)

Resin for coating layer (resin 2 of Resin Synthesis Example 2, solid content: 25% by mass): 28 parts by mass Electroconductive filler 5 (Filler Production Example 5): 15 parts by mass Catalyst: 1 part by mass (diisopropoxybis(ethylacetoacetate)titanium)

(ORGATIX TC-750, product of Matsumoto Fine Chemical Co., Ltd.)

Silane coupling agent: 0.5 parts by mass (SH6020, product of Dow Corning Toray Co., Ltd.)

Toluene: balance

Example 14

Production of Latent Electrostatic Image Developing Carrier N

[Coating layer forming solution N] (solid content: 10% by mass) having the following composition was prepared to form a coating layer of latent electrostatic image developing carrier N. The [core particles 6] (1,000 parts by mass) were coated with the [coating layer forming solution N] and dried. Here, the coating and the drying were performed using a fluidized-bed coating apparatus the fluidized vessels of which had been each controlled to 70° C. The obtained carrier was fired in an electric furnace at 180° C. for 2 hours to obtain [carrier N]. The properties of the [carrier N] are shown in Table 1.

[Composition of Coating Layer Forming Solution N]

Resin for coating layer (silicone resin): 35 parts by mass (methylsilicone resin produced from a difunctional or trifunctional monomer)

(weight average molecular weight: 15,000, solid content: 25% by mass)

Resin for coating layer (resin 2 of Resin Synthesis Example 2, solid content: 25% by mass): 9 parts by mass Electroconductive filler 1 (Filler Production Example 1): 7 parts by mass Catalyst: 1 part by mass (diisopropoxybis(ethylacetoacetate)titanium)

(ORGATIX TC-750, product of Matsumoto Fine Chemical Co., Ltd.)

Silane coupling agent: 0.3 parts by mass (SH6020, product of Dow Corning Toray Co., Ltd.)

Toluene: balance

Example 15

Production of Latent Electrostatic Image Developing Carrier O

[Coating layer forming solution O] (solid content: 10% by mass) having the following composition was prepared to form a coating layer of latent electrostatic image developing carrier O. The [core particles 8] (1,000 parts by mass) were coated with the [coating layer forming solution O] and dried. Here, the coating and the drying were performed using a multi-functional mixer. Specifically, the [core particles 8] which had been heated to 100° C. and the [coating layer forming solution O] were charged into the multi-functional mixer, where mixing/stirring blades were rotated to perform coating, stirring and drying until the coating liquid was evaporated. The obtained carrier was fired in an electric furnace at 180° C. for 2 hours to obtain [carrier O]. The properties of the [carrier O] are shown in Table 1.

[Composition of Coating Layer Forming Solution O]

Resin for coating layer (silicone resin): 26 parts by mass (methylsilicone resin produced from a difunctional or trifunctional monomer)

(weight average molecular weight: 15,000, solid content: 25% by mass)

Resin for coating layer (acrylic resin): 2.5 parts by mass (HITALOID3001, product of Hitachi Chemical Co., Ltd., solid content: 50% by mass)

Resin for coating layer (benzoguanamine resin): 5 parts by mass (MYCOAT106, product of Mitsui Cytec Ltd., solid content: 77% by mass)

Electroconductive filler 3 (Filler Production Example 3): 10 parts by mass

Catalyst: 2 parts by mass (diisopropoxybis(ethylacetoacetate)titanium)

(ORGATIX TC-750, product of Matsumoto Fine Chemical Co., Ltd.)

Silane coupling agent: 0.3 parts by mass (SH6020, product of Dow Corning Toray Co., Ltd.)

Toluene: balance

Comparative Example 1

Production of Latent Electrostatic Image Developing Carrier P

[Coating layer forming solution P] (solid content: 10% by mass) having the following composition was prepared to form a coating layer of latent electrostatic image developing carrier P. The [core particles 1] (1,000 parts by mass) were coated with the [coating layer forming solution P] and dried. Here, the coating and the drying were performed using a fluidized-bed coating apparatus the fluidized vessels of which had been each controlled to 70° C. The obtained carrier was fired in an electric furnace at 180° C. for 2 hours to obtain [carrier P]. The properties of the [carrier P] are shown in Table 1.

[Composition of Coating Layer Forming Solution P]

Resin for coating layer (silicone resin): 16 parts by mass (methylsilicone resin produced from a difunctional or trifunctional monomer)

(weight average molecular weight: 15,000, solid content: 25% by mass)

Electroconductive filler 3 (Filler Production Example 3): 2 parts by mass

Catalyst: 1 part by mass (diisopropoxybis(ethylacetoacetate)titanium)

(ORGATIX TC-750, product of Matsumoto Fine Chemical Co., Ltd.)

Silane coupling agent: 0.2 parts by mass (SH6020, product of Dow Corning Toray Co., Ltd.)

Toluene: balance

Comparative Example 2

Production of Latent Electrostatic Image developing carrier Q

[Coating layer forming solution Q] (solid content: 10% by mass) having the following composition was prepared to form a coating layer of latent electrostatic image developing carrier Q. The [core particles 1] (1,000 parts by mass) were coated with the [coating layer forming solution Q] and dried. Here, the coating and the drying were performed using a fluidized-bed coating apparatus the fluidized vessels of which had been each controlled to 70° C. The obtained carrier was fired in an electric furnace at 180° C. for 2 hours to obtain [carrier Q]. The properties of the [carrier Q] are shown in Table 1.

[Composition of Coating Layer Forming Solution Q]

Resin for coating layer (silicone resin): 120 parts by mass (methylsilicone resin produced from a difunctional or trifunctional monomer)

(weight average molecular weight: 15,000, solid content: 25% by mass)

Electroconductive filler 1 (Filler Production Example 1): 160 parts by mass

Catalyst: 6 part by mass (diisopropoxybis(ethylacetoacetate)titanium)

(ORGATIX TC-750, product of Matsumoto Fine Chemical Co., Ltd.)

Silane coupling agent: 1.2 parts by mass (SH6020, product of Dow Corning Toray Co., Ltd.)

Toluene: balance

Comparative Example 3

Production of Latent Electrostatic Image Developing Carrier R

[Coating layer forming solution R] (solid content: 10% by mass) having the following composition was prepared to form a coating layer of latent electrostatic image developing carrier R. The [core particles 3] (1,000 parts by mass) were coated with the [coating layer forming solution R] and dried. Here, the coating and the drying were performed using a fluidized-bed coating apparatus the fluidized vessels of which had been each controlled to 70° C. The obtained carrier was fired in an electric furnace at 180° C. for 2 hours to obtain [carrier R]. The properties of the [carrier R] are shown in Table 1.

[Composition of Coating Layer Forming Solution R]

Resin for coating layer (silicone resin): 40 parts by mass (methylsilicone resin produced from a difunctional or trifunctional monomer)

(weight average molecular weight: 15,000, solid content: 25% by mass)

Electroconductive filler (containing barium sulfate): 20 parts by mass (PASTRAN4310, product of MITSUI MINING & SMELTING CO., LTD.)

(average particle diameter: 150 nm, volume specific resistance: 12 Ω·cm)

Catalyst: 2 parts by mass (diisopropoxybis(ethylacetoacetate)titanium)

(ORGATIX TC-750, product of Matsumoto Fine Chemical Co., Ltd.)

Silane coupling agent: 0.3 parts by mass (SH6020, product of Dow Corning Toray Co., Ltd.)

Toluene: balance

Comparative Example 4

Production of Latent Electrostatic Image Developing Carrier S

[Coating layer forming solution S] (solid content: 10% by mass) having the following composition was prepared to form a coating layer of latent electrostatic image developing carrier S. The [core particles 3] (1,000 parts by mass) were coated with the [coating layer forming solution S] and dried. Here, the coating and the drying were performed using a fluidized-bed coating apparatus the fluidized vessels of which had been each controlled to 70° C. The obtained carrier was fired in an electric furnace at 180° C. for 2 hours to obtain [carrier S]. The properties of the [carrier S] are shown in Table 1.

[Composition of Coating Layer Forming Solution S]

Resin for coating layer (silicone resin): 68 parts by mass (methylsilicone resin produced from a difunctional or trifunctional monomer)

(weight average molecular weight: 15,000, solid content: 25% by mass)

Electroconductive filler 3 (Filler Production Example 3): 34 parts by mass

Catalyst: 3 part by mass (diisopropoxybis(ethylacetoacetate)titanium)

(ORGATIX TC-750, product of Matsumoto Fine Chemical Co., Ltd.)

Silane coupling agent: 0.6 parts by mass (SH6020, product of Dow Corning Toray Co., Ltd.)

Toluene: balance

Comparative Example 5

Production of Latent Electrostatic Image Developing Carrier T

[Coating layer forming solution T] (solid content: 10% by mass) having the following composition was prepared to form a coating layer of latent electrostatic image developing carrier T. The [core particles 5] (1,000 parts by mass) were coated with the [coating layer forming solution T] and dried. Here, the coating and the drying were performed using a multi-functional mixer. Here, the coating and the drying were performed using a fluidized-bed coating apparatus the fluidized vessels of which had been each controlled to 70° C. The obtained carrier was fired in an electric furnace at 180° C. for 2 hours to obtain [carrier T]. The properties of the [carrier T] are shown in Table 1.

[Composition of Coating Layer Forming Solution T]

Resin for coating layer (acrylic resin): 35 parts by mass (HITALOID3001, product of Hitachi Chemical Co., Ltd., solid content: 50% by mass)

Resin for coating layer (benzoguanamine resin): 10 parts by mass (MYCOAT106, product of Mitsui Cytec Ltd., solid content: 77% by mass)

Electroconductive filler 4 (Filler Production Example 4): 140 parts by mass

Catalyst (CATALYST4040, product of Mitsui Cytec Ltd.): 0.2 parts by mass

Silane coupling agent: 0.8 parts by mass (SH6020, product of Dow Corning Toray Co., Ltd.)

Toluene: balance

Comparative Example 6

Production of Latent Electrostatic Image Developing Carrier U

[Coating layer forming solution U] (solid content: 10% by mass) having the following composition was prepared to form a coating layer of latent electrostatic image developing carrier U. The [core particles 6] (1,000 parts by mass) were coated with the [coating layer forming solution U] and dried. Here, the coating and the drying were performed using a fluidized-bed coating apparatus the fluidized vessels of which had been each controlled to 70° C. The obtained carrier was fired in an electric furnace at 180° C. for 2 hours to obtain [carrier U]. The properties of the [carrier U] are shown in Table 1.

[Composition of Coating Layer Forming Solution U]

Resin for coating layer (silicone resin): 64 parts by mass (methylsilicone resin produced from a difunctional or trifunctional monomer)

(weight average molecular weight: 15,000, solid content: 25% by mass)

Electroconductive filler 3 (Filler Production Example 3): 56 parts by mass

Catalyst: 6 part by mass (diisopropoxybis(ethylacetoacetate)titanium)

(ORGATIX TC-750, product of Matsumoto Fine Chemical Co., Ltd.)

Silane coupling agent: 0.6 parts by mass (SH6020, product of Dow Corning Toray Co., Ltd.)

Toluene: balance

Comparative Example 7

Production of Latent Electrostatic Image Developing Carrier V

[Coating layer forming solution V] (solid content: 10% by mass) having the following composition was prepared to form a coating layer of latent electrostatic image developing carrier V. The [core particles 7] (1,000 parts by mass) were coated with the [coating layer forming solution V] and dried. Here, the coating and the drying were performed using a fluidized-bed coating apparatus the fluidized vessels of which had been each controlled to 70° C. The obtained carrier was fired in an electric furnace at 180° C. for 2 hours to obtain [carrier V]. The properties of the [carrier V] are shown in Table 1.

[Composition of Coating Layer Forming Solution V]

Resin for coating layer (silicone resin): 80 parts by mass (methylsilicone resin produced from a difunctional or trifunctional monomer)

(weight average molecular weight: 15,000, solid content: 25% by mass)

Electroconductive filler (carbon black): 2 parts by mass (REGAL330, product of Cabot Corporation)

(average particle diameter: 25 nm, volume specific resistance: 0.1 Ω·cm)

Catalyst: 4 parts by mass (diisopropoxybis(ethylacetoacetate)titanium)

(ORGATIX TC-750, product of Matsumoto Fine Chemical Co., Ltd.)

Silane coupling agent: 0.6 parts by mass (SH6020, product of Dow Corning Toray Co., Ltd.)

Toluene: balance

Comparative Example 7

Production of Latent Electrostatic Image Developing Carrier W

[Coating layer forming solution W] (solid content: 10% by mass) having the following composition was prepared to form a coating layer of latent electrostatic image developing carrier W. The [core particles 4] (1,000 parts by mass) were coated with the [coating layer forming solution W] and dried. Here, the coating and the drying were performed using a fluidized-bed coating apparatus the fluidized vessels of which had been each controlled to 70° C. The obtained carrier was fired in an electric furnace at 180° C. for 2 hours to obtain [carrier W]. The properties of the [carrier W] are shown in Table 1.

[Composition of Coating Layer Forming Solution W]

Resin for coating layer (silicone resin): 48 parts by mass (methylsilicone resin produced from a difunctional or trifunctional monomer)

(weight average molecular weight: 15,000, solid content: 25% by mass)

Electroconductive filler 1 (Filler Production Example 1): 10 parts by mass

Catalyst: 2 parts by mass (diisopropoxybis(ethylacetoacetate)titanium)

(ORGATIX TC-750, product of Matsumoto Fine Chemical Co., Ltd.)

Silane coupling agent: 0.4 parts by mass (SH6020, product of Dow Corning Toray Co., Ltd.)

Toluene: balance (Production of Developer)

Each (930 parts by mass) of the [carrier A] to [carrier W] obtained in Examples and Comparative Examples was mixed with a toner (70 parts by mass) for use in a commercially available digital full-color printer (RICOH Pro C901, product of Ricoh Company, Ltd.), followed by stirring at 81 rpm for 5 min using a turbular mixer, to thereby produce a developer for evaluation. Also, replenishing developers were each produced from the above carrier and the above toner so that the concentration of the toner became 10% by mass.

(Evaluation)

The latent electrostatic image developing carriers obtained in Examples and Comparative Examples were evaluated. The results are shown in Table 2.

<Evaluation of Printed Images>

Each of the thus-produced developers and each of the thus-produced replenishing developers were set to a commercially available digital color printer (RICOH Pro C901, product of Ricoh Company, Ltd.). Then, the printer was caused to print, on 100,000 sheets, a letter chart with an image area of 8% (the size of one letter: about 2 mm×about 2 mm) and further to print the letter chart on 200,000 sheets.

<Evaluation of Influence Due to Hysteresis>

Figure 5A:
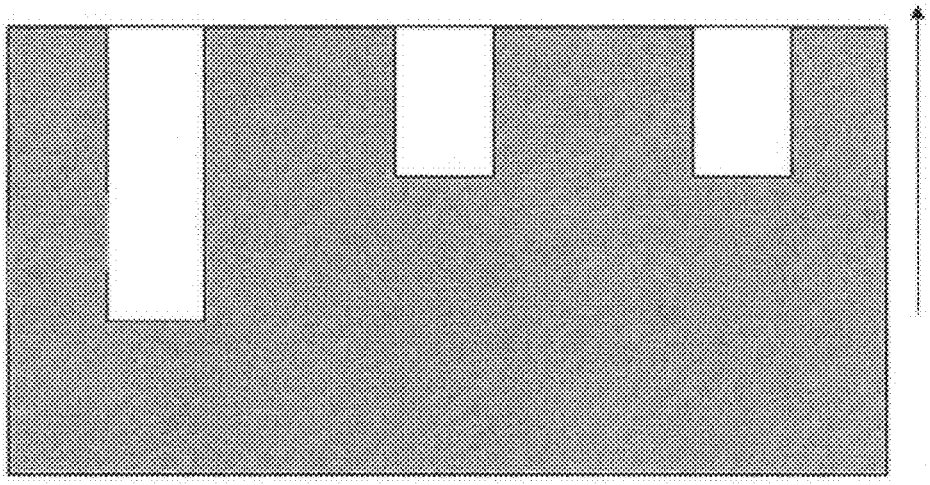
FIG. 5A is a normal image of a band chart.

In order to evaluate influence due to hysteresis, the above printer after the printing of 100,000 sheets (i.e., 100 kp) in the above evaluation of printed images was caused to print a band chart illustrated in FIG. 5A. The difference between the image densities of images corresponding to the first one rotation (a) of the sleeve (toner bearing member) and the second one rotation (b) subsequent to the first one rotation (a) was measured to evaluate the influence due to the hysteresis of the previous image. The measurement was performed with a color meter (X-Rite938, product of X-Rite, Co.). Three portions of the image corresponding to the center, rear and front of the sleeve were measured, and an average difference among the obtained measurements was calculated as ΔID, which was evaluated according to the following evaluation criteria: "A: very good," "B: good," "C: acceptable," which are regarded as applicable levels, and "D: practically unacceptable," which is regarded as a non-applicable level. Notably, the smaller ΔID means the less influence due to hysteresis for the previous image formation.

Figure 5B:
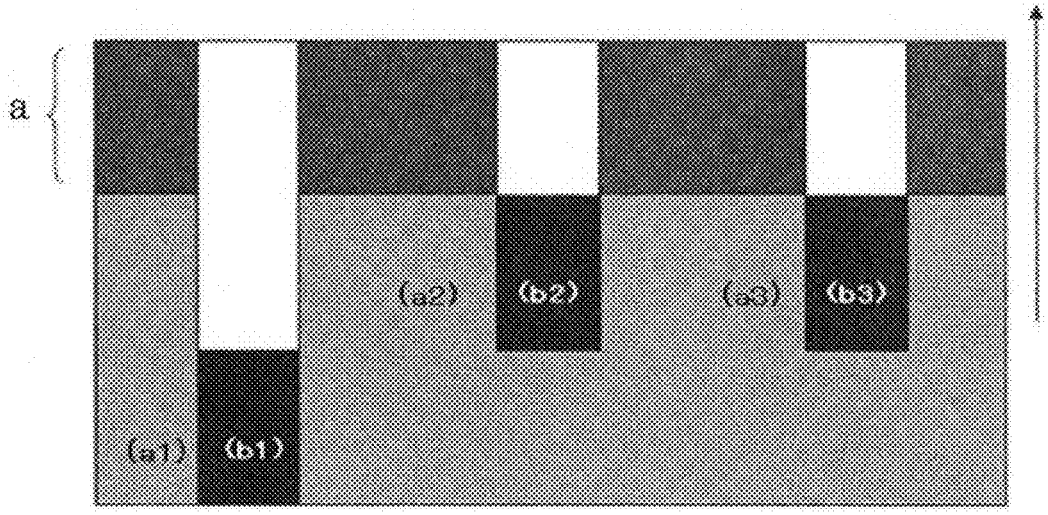
FIG. 5B is one exemplary abnormal image formed after printing of a band chart.

In FIG. 5A, the arrow indicates the direction in which the paper sheet is fed, and the gray portion and the blank portion indicate an image portion and a non-image portion, respectively. FIG. 5B exemplarily illustrates an abnormal image observed after the printing of the band chart. In FIG. 5B, the arrow indicates the direction in which the paper sheet is fed, "a" denotes an image corresponding to one rotation of the sleeve, the white portions are non-image portions, and (a1), (a2), (a3), (b1) and (b2) are images receiving the influence due to the hysteresis of the previous image.

[Evaluation Criteria]

A: $\Delta ID \leq 0.01$

B: $0.01 < \Delta ID \leq 0.03$

C: $0.03 < \Delta ID \leq 0.06$

D: $0.06 < \Delta ID$

<Evaluation of Amount of Spent Toner>

The toner attached to the latent electrostatic image developing carrier before printing (i.e., the number of printed sheets: 0) was extracted with methyl ethyl ketone. Separately, the toner attached to the latent electrostatic image developing carrier in the developer after the printing of 300,000 sheets in the above evaluation of printed images was extracted with methyl ethyl ketone. The difference between the above amounts of the toner extracted with methyl ethyl ketone is defined as the amount of spent toner, which was evaluated according to the following evaluation criteria: "A: very good," "B: good," "C: acceptable," which are regarded as applicable levels, and "D: practically unacceptable," which is regarded as a non-applicable level.

[Evaluation Criteria]

A: The amount of spent toner was 0% by mass or more but less than 0.03% by mass.

B: The amount of spent toner was 0.03% by mass or more but less than 0.07% by mass.

C: The amount of spent toner was 0.07% by mass or more but less than 0.15% by mass.

D: The amount of spent toner was 0.15% by mass or more.

<Evaluation of Change in Resistance of Latent Electrostatic Image Developing Carrier>

Figure 3:
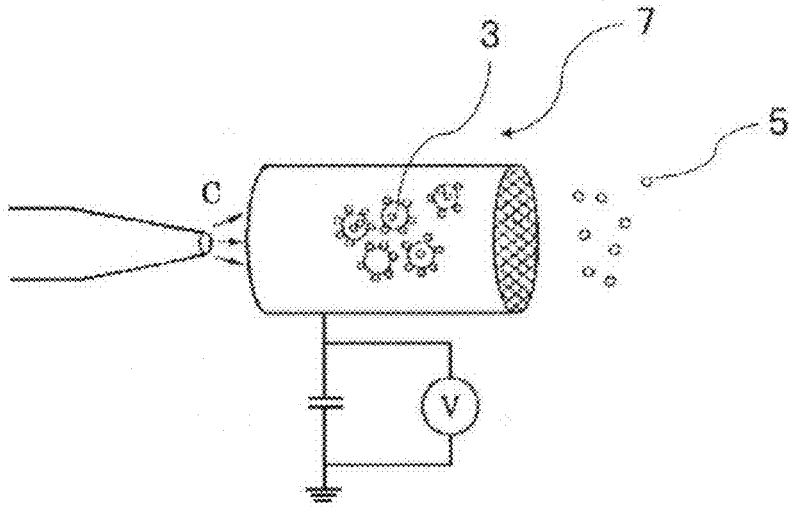
FIG. 3 illustrates one exemplary method for measuring the electrical resistance of a latent electrostatic image developing carrier of the present invention.
Figure 4:
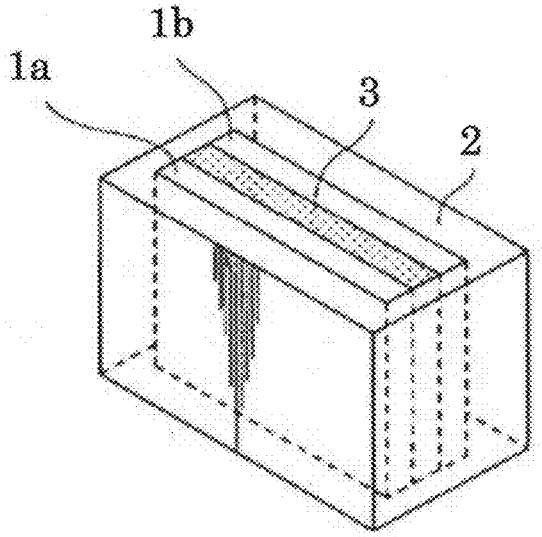
FIG. 4 is a perspective view of one exemplary measurement cell used for measurement of the electrical resistance of a latent electrostatic image developing carrier of the present invention.

The resistance of the latent electrostatic image developing carrier in the developer before printing (i.e., the number of printed sheets: 0), the resistance of the latent electrostatic image developing carrier in the developer after the printing of 100,000 sheets (i.e., 100 kp) in the above evaluation of printed images, and the resistance of the latent electrostatic image developing carrier in the developer after the printing of 300,000 sheets (i.e., 300 kp) in the above evaluation of printed images were measured, and the difference between the resistance measured before printing and the resistance measured after 100 kp and the difference between the resistance measured before printing and the resistance measured after 300 kp were measured to evaluate change in resistance of the carrier over time. As illustrated in FIG. 3, a blow-off cage 7 with a 795-mesh net and compressive gas (denoted by "C" in FIG. 3) was used to aspirate off toner particles 5 from the developer, and the resultant latent electrostatic image developing carrier 3 was subjected to measurement. The resistance of the latent electrostatic image developing carrier was measured using a cell of a fluorine resin container 2 housing electrodes 1*a* and 1*b* which are disposed 2 mm apart and each have a surface area of 2 cm×4 cm, as illustrated in FIG. 4.

Specifically, the latent electrostatic image developing carrier 3 was charged to the cell and a DC voltage of 1,000 V was applied to between the electrodes. Then, a DC resistance was measured with HIGH RESISTANCE METER (4329A+LJK 5HVLVWDQFH OHWHU, product of YOKOKAWA Hewlett-Packard Co, Ltd.). Thereafter, the difference Δ Log R between the measured resistance and the resistance measured before printing (i.e., after printing of 0 sheets) was calculated. The evaluation was made according to the following criteria: "A: very good," "B: good," "C: acceptable," which are regarded as applicable levels, and "D: practically unacceptable," which is regarded as a non-applicable level.

[Evaluation Criteria]

A: Δ Log R≤0.5

B: 0.5<Δ Log R≤1.0

C: 1.0<Δ Log R≤2.0

D: 2.0<Δ Log R

TABLE 1

| | Properties of latent electrostatic image developing carrier | | | | | | | |
|---|---|---|---|---|---|---|---|---|
| | Type of carrier (—) | SF-2 of carrier (—) | Bulk density of carrier (g/cm$^3$) | Type of core particles (—) | Ra of core particles (μm) | SF-2 of core particles (—) | Amount of filler contained in 100 parts by mass of resin (parts by mass) | Amount of resin relative to core particles (% by mass) |
| Ex. 1 | A | 128 | 2.24 | CP* 1 | 0.7 | 145 | 272 | 2.06 |
| Ex. 2 | B | 134 | 2.19 | CP 1 | 0.7 | 145 | 195 | 1.13 |
| Ex. 3 | C | 130 | 2.15 | CP 1 | 0.7 | 145 | 97 | 1.50 |
| Ex. 4 | D | 127 | 2.25 | CP 1 | 0.7 | 145 | 272 | 2.06 |
| Ex. 5 | E | 136 | 2.21 | CP 1 | 0.7 | 145 | 234 | 1.13 |
| Ex. 6 | F | 117 | 2.34 | CP 1 | 0.7 | 145 | 408 | 2.37 |
| Ex. 7 | G | 132 | 2.17 | CP 1 | 0.7 | 145 | 145 | 1.24 |
| Ex. 8 | H | 137 | 2.16 | CP 2 | 0.93 | 152 | 245 | 1.55 |
| Ex. 9 | I | 148 | 2.02 | CP 5 | 0.85 | 155 | 113 | 0.62 |
| Ex. 10 | J | 126 | 2.38 | CP 5 | 0.85 | 155 | 463 | 2.90 |
| Ex. 11 | K | 139 | 2.14 | CP 5 | 0.85 | 155 | 245 | 1.55 |
| Ex. 12 | L | 137 | 2.12 | CP 5 | 0.85 | 155 | 195 | 1.13 |
| Ex. 13 | M | 143 | 2.06 | CP 5 | 0.85 | 155 | 103 | 1.45 |
| Ex. 14 | N | 117 | 2.22 | CP 6 | 0.63 | 122 | 62 | 1.13 |
| Ex. 15 | O | 136 | 2.10 | CP 8 | 0.68 | 140 | 118 | 0.85 |
| Comp. Ex. 1 | P | 140 | 2.10 | CP 1 | 0.7 | 145 | 48 | 0.42 |
| Comp. Ex. 2 | Q | 114 | 2.45 | CP 1 | 0.7 | 145 | 513 | 3.12 |
| Comp. Ex. 3 | R | 116 | 2.31 | CP 3 | 0.45 | 119 | 194 | 1.03 |
| Comp. Ex. 4 | S | 112 | 2.36 | CP 3 | 0.45 | 119 | 193 | 1.76 |
| Comp. Ex. 5 | T | 128 | 2.43 | CP 5 | 0.85 | 155 | 543 | 2.58 |
| Comp. Ex. 6 | U | 114 | 2.36 | CP 6 | 0.63 | 122 | 337 | 1.65 |
| Comp. Ex. 7 | V | 145 | 1.98 | CP 7 | 1.03 | 165 | 10 | 2.06 |
| Comp. Ex. 8 | W | 118 | 1.78 | CP 4 | 0.75 | 125 | 81 | 1.24 |

*CP is an abbreviation of "core particles."

TABLE 2

| | Evaluation results | | | |
|---|---|---|---|---|
| | Influence due to hysteresis after 100 kp | Change in resistance after 100 kp | Change in resistance after 300 kp | Amount of spent toner |
| Ex. 1 | A | A | A | A |
| Ex. 2 | A | A | A | A |
| Ex. 3 | A | A | B | B |

TABLE 2-continued

| | Evaluation results | | | |
|---|---|---|---|---|
| | Influence due to hysteresis after 100 kp | Change in resistance after 100 kp | Change in resistance after 300 kp | Amount of spent toner |
| Ex. 4 | A | A | A | A |
| Ex. 5 | A | A | A | A |
| Ex. 6 | B | A | B | A |
| Ex. 7 | A | A | A | A |
| Ex. 8 | A | A | A | A |
| Ex. 9 | B | A | B | A |
| Ex. 10 | B | A | B | B |
| Ex. 11 | A | A | A | A |
| Ex. 12 | A | A | A | A |
| Ex. 13 | A | A | A | A |
| Ex. 14 | B | B | C | A |

TABLE 2-continued

| | Evaluation results | | | |
|---|---|---|---|---|
| | Influence due to hysteresis after 100 kp | Change in resistance after 100 kp | Change in resistance after 300 kp | Amount of spent toner |
| Ex. 15 | A | B | B | B |
| Comp. Ex. 1 | A | C | D | A |

TABLE 2-continued

| | Evaluation results | | | |
|---|---|---|---|---|
| | Influence due to hysteresis after 100 kp | Change in resistance after 100 kp | Change in resistance after 300 kp | Amount of spent toner |
| Comp. Ex. 2 | D | B | C | C |
| Comp. Ex. 3 | D | A | A | B |
| Comp. Ex. 4 | D | B | B | D |
| Comp. Ex. 5 | B | D | D | D |
| Comp. Ex. 6 | D | A | A | B |
| Comp. Ex. 7 | A | C | D | A |
| Comp. Ex. 8 | B | B | C | A |

The developers containing the latent electrostatic image developing carriers produced in Examples 1 to 15 were good since these were found to be small in ΔID after the printing of 100,000 sheets. Also, the developers containing the latent electrostatic image developing carriers produced in Examples 1 to 15 were found to be smaller in change between the resistance measured before printing (i.e., after printing of 0 sheets) and the resistance measured after the printing of 100,000 sheets and in change between the resistance measured before printing and the resistance measured after the printing of 300,000 sheets. Also in these developers, the amount of spent toner was small and less change in image was observed.

In contrast, the developers containing the latent electrostatic image developing carriers produced in Comparative Examples 2, 3, 4 and 6 were found to be large in ΔID after the printing of 100,000 sheets, be greatly affected by hysteresis for the previous image formation, and form visually observed abnormal images. The developer containing the latent electrostatic image developing carrier produced in Comparative Example 5 was found to exhibit a large amount of spent toner, background smear caused by reduction in charge amount, toner scattering in the apparatus, and elevation in image density. The latent electrostatic image developing carriers produced in Comparative Examples 1 and 7 were found to large in change between the resistance measured before printing (i.e., the number of printed sheets: 0) and the resistance measured after the printing of 300,000 sheets, and changes in image quality were observed such as reduction in amount of toner on thin lines and elevation of image density. The latent electrostatic image developing carrier produced in Comparative Example 8 was found to cause carrier deposition so much. As a result, the carrier was scattered and attached onto the image, leading to image failures.

As described above, it is found that the latent electrostatic image developing carriers produced in Examples 1 to 15, even when used continuously for a long period of time, can stably supply a necessary amount of toner to a latent electrostatic image bearing member without being affected by hysteresis, and can prevent an increase in resistance due to deposition of spent toner thereon.

Aspects of the present invention are as follows.

<1> A latent electrostatic image developing carrier including:

core particles each having magnetism; and a coating layer covering each of the core particles, wherein the latent electrostatic image developing carrier has a shape factor SF-2 of 115 to 150 and has a bulk density of 1.8 g/cm$^3$ to 2.4 g/cm$^3$, wherein the core particles have a shape factor SF-2 of 120 to 160 and have an arithmetic mean surface roughness Ra of 0.5 μm to 1.0 μm, and wherein the coating layer contains a resin and a filler and an amount of the filler contained in the coating layer is 50 parts by mass to 500 parts by mass per 100 parts by mass of the resin contained in the coating layer.

<2> The latent electrostatic image developing carrier according to <1>, wherein the filler contains at least an electroconductive filler and a non-electroconductive filler.

<3> The latent electrostatic image developing carrier according to <1> or <2>, wherein the filler contains at least one selected from the group consisting of aluminum oxide, titanium oxide and barium sulfate.

<4> The latent electrostatic image developing carrier according to any one of <1> to <3>, wherein the filler has a number average particle diameter of 50 nm to 800 nm.

<5> The latent electrostatic image developing carrier according to any one of <1> to <4>, wherein the resin contains a silicone resin.

<6> The latent electrostatic image developing carrier according to any one of <1> to <5>, wherein the resin contains a cured product of a mixture containing a silane coupling agent and a silicone resin.

<7> The latent electrostatic image developing carrier according to any one of <1> to <6>, wherein the resin contains a crosslinked product formed by hydrolyzing a copolymer containing at least unit A represented by the following General Formula (A) and unit B represented by the following General Formula (B) to form a silanol group, followed by condensation:

General Formula (A)

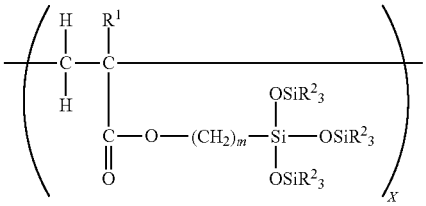

in General Formula (A), $R^1$ represents a hydrogen atom or a methyl group, $R^2$ represents an alkyl group having 1 to 4 carbon atoms, m is an integer of 1 to 8, and X is a molar ratio of the unit A in the copolymer and is 10 mol % to 90 mol %, General Formula (B)

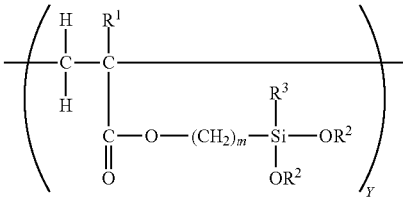

in General Formula (B), $R^1$ represents a hydrogen atom or a methyl group, $R^2$ represents an alkyl group having 1 to 4 carbon atoms, $R^3$ represents an alkyl group having 1 to 8 carbon atoms or an alkoxy group having 1 to 4 carbon atoms, m is an integer of 1 to 8, and Y is a molar ratio of the unit B in the copolymer and is 10 mol % to 90 mol %.

<8> The latent electrostatic image developing carrier according to any one of <1> to <7>, wherein the amount of the filler contained in the coating layer is 100 parts by mass to 300 parts by mass per 100 parts by mass of the resin contained in the coating layer.

<9> The latent electrostatic image developing carrier according to any one of <1> to <8>, wherein an amount of the resin is 0.5% by mass to 3.0% by mass relative to an amount of the core particles.

<10> The latent electrostatic image developing carrier according to any one of <1> to <9>, wherein the coating layer is formed on the core particles with a fluidized-bed coating apparatus.

<11> A process cartridge including:

a latent electrostatic image bearing member; and a developing unit configured to develop a latent electrostatic image on the latent electrostatic image bearing member with a developer containing a toner and the latent electrostatic image developing carrier according to any one of <1> to <10>, wherein the latent electrostatic image bearing member is supported integrally with the developing unit.

<12> An image forming apparatus including:

a unit configured to form a latent electrostatic image on a latent electrostatic image bearing member;

a unit configured to develop the latent electrostatic image on the latent electrostatic image bearing member with a developer containing a toner and the latent electrostatic image developing carrier according to any one of <1> to <10>, to thereby form a toner image;

a unit configured to transfer the toner image from the latent electrostatic image bearing member to a recording medium; and a unit configured to fix the toner image transferred on the recording medium.

<13> The image forming apparatus according to <12>, wherein the unit configured to develop the latent electrostatic image is a unit configured to develop the latent electrostatic image with the developer with which magnetic brushes are formed, to thereby form the toner image.

This application claims priority to Japanese application No. 2011-196277, filed on Sep. 8, 2011, and incorporated herein by reference.

What is claimed is:

1. A latent electrostatic image developing carrier comprising:

core particles each having magnetism; and a coating layer covering each of the core particles, wherein the latent electrostatic image developing carrier has a shape factor SF-2 of 115 to 150 and has a bulk density of 1.8 g/cm$^3$ to 2.4 g/cm$^3$, wherein the core particles have a shape factor SF-2 of 120 to 160 and have an arithmetic mean surface roughness Ra of 0.5 μm to 1.0 μm, and wherein the coating layer contains a resin and a filler and an amount of the filler contained in the coating layer is 50 parts by mass to 500 parts by mass per 100 parts by mass of the resin contained in the coating layer.

2. The latent electrostatic image developing carrier according to claim 1, wherein the filler contains at least an electroconductive filler and a non-electroconductive filler.

3. The latent electrostatic image developing carrier according to claim 1, wherein the filler contains at least one selected from the group consisting of aluminum oxide, titanium oxide and barium sulfate.

4. The latent electrostatic image developing carrier according to claim 1, wherein the filler has a number average particle diameter of 50 nm to 800 nm.

5. The latent electrostatic image developing carrier according to claim 1, wherein the resin contains a silicone resin.

6. The latent electrostatic image developing carrier according to claim 1, wherein the resin contains a cured product of a mixture containing a silane coupling agent and a silicone resin.

7. The latent electrostatic image developing carrier according to claim 1, wherein the resin contains a crosslinked product formed by hydrolyzing a copolymer containing at least unit A represented by the following General Formula (A) and unit B represented by the following General Formula (B) to form a silanol group, followed by condensation:

General Formula (A)

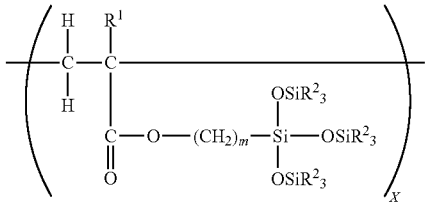

in General Formula (A), $R^1$ represents a hydrogen atom or a methyl group, $R^2$ represents an alkyl group having 1 to 4 carbon atoms, m is an integer of 1 to 8, and X is a molar ratio of the unit A in the copolymer and is 10 mol % to 90 mol %, General Formula (B)

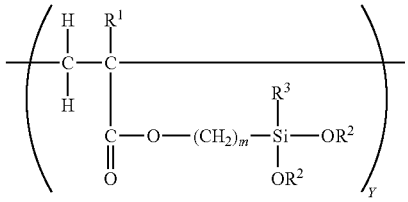

in General Formula (B), $R^1$ represents a hydrogen atom or a methyl group, $R^2$ represents an alkyl group having 1 to 4 carbon atoms, $R^3$ represents an alkyl group having 1 to 8 carbon atoms or an alkoxy group having 1 to 4 carbon atoms, m is an integer of 1 to 8, and Y is a molar ratio of the unit B in the copolymer and is 10 mol % to 90 mol %.

8. The latent electrostatic image developing carrier according to claim 1, wherein the amount of the filler contained in the coating layer is 100 parts by mass to 300 parts by mass per 100 parts by mass of the resin contained in the coating layer.

9. The latent electrostatic image developing carrier according to claim 1, wherein an amount of the resin is 0.5% by mass to 3.0% by mass relative to an amount of the core particles.

10. The latent electrostatic image developing carrier according to claim 1, wherein the coating layer is formed on the core particles with a fluidized-bed coating apparatus.

11. A process cartridge comprising:

a latent electrostatic image bearing member; and a developing unit configured to develop a latent electrostatic image on the latent electrostatic image bearing member with a developer containing a toner and a latent electrostatic image developing carrier, wherein the latent electrostatic image bearing member is supported integrally with the developing unit, wherein the latent electrostatic image developing carrier comprises:

core particles each having magnetism; and a coating layer covering each of the core particles, wherein the latent electrostatic image developing carrier has a shape factor SF-2 of 115 to 150 and has a bulk density of 1.8 g/cm$^3$ to 2.4 g/cm$^3$, wherein the core particles have a shape factor SF-2 of 120 to 160 and have an arithmetic mean surface roughness Ra of 0.5 μm to 1.0 μm, and wherein the coating layer contains a resin and a filler and an amount of the filler contained in the coating layer is 50 parts by mass to 500 parts by mass per 100 parts by mass of the resin contained in the coating layer.

12. An image forming apparatus comprising:

a unit configured to form a latent electrostatic image on a latent electrostatic image bearing member;

a unit configured to develop the latent electrostatic image on the latent electrostatic image bearing member with a developer containing a toner and a latent electrostatic image developing carrier, to thereby form a toner image;

a unit configured to transfer the toner image from the latent electrostatic image bearing member to a recording medium; and a unit configured to fix the toner image transferred on the recording medium, wherein the latent electrostatic image developing carrier comprises:

core particles each having magnetism; and a coating layer covering each of the core particles, wherein the latent electrostatic image developing carrier has a shape factor SF-2 of 115 to 150 and has a bulk density of 1.8 g/cm$^3$ to 2.4 g/cm$^3$, wherein the core particles have a shape factor SF-2 of 120 to 160 and have an arithmetic mean surface roughness Ra of 0.5 μm to 1.0 μm, and wherein the coating layer contains a resin and a filler and an amount of the filler contained in the coating layer is 50 parts by mass to 500 parts by mass per 100 parts by mass of the resin contained in the coating layer.

13. The image forming apparatus according to claim 12, wherein the unit configured to develop the latent electrostatic image is a unit configured to develop the latent electrostatic image with the developer with which magnetic brushes are formed, to thereby form the toner image.

* * * * *